US007522026B2

(12) United States Patent
Kitahara et al.

(10) Patent No.: US 7,522,026 B2
(45) Date of Patent: Apr. 21, 2009

(54) ALIGNMENT METHOD AND SYSTEM FOR ELECTROMAGNET IN HIGH-ENERGY ACCELERATOR

(75) Inventors: Takashi Kitahara, Tokyo (JP); Shizuo Imaoka, Tokyo (JP); Yuuichi Yamamoto, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 371 days.

(21) Appl. No.: 11/563,040

(22) Filed: Nov. 24, 2006

(65) Prior Publication Data

US 2007/0273464 A1 Nov. 29, 2007

(30) Foreign Application Priority Data

Nov. 25, 2005 (JP) ..... 2005-339637

(51) Int. Cl.
*H01F 5/00* (2006.01)

(52) U.S. Cl. ..... 335/296; 335/299; 250/505.1

(58) Field of Classification Search ..... 335/296, 335/299; 250/396 ML, 505.1; 315/5.34–5.35
See application file for complete search history.

(56) References Cited

U.S. PATENT DOCUMENTS 3,590,465 A * 7/1971 Cartier et al. ..... 33/700
4,320,577 A * 3/1982 Lauritzen ..... 250/252.1
5,072,516 A * 12/1991 Jarabak et al. ..... 29/609
5,698,954 A * 12/1997 Hirota et al. ..... 315/503
6,774,383 B2 * 8/2004 Norimine et al. ..... 250/505.1

FOREIGN PATENT DOCUMENTS

| | | |
|---|---|---|
| JP | 06-163197 | 6/1994 |
| JP | 11-214198 | 8/1999 |
| JP | 2000-208300 | 7/2000 |
| JP | 3190923 | 7/2001 |

* cited by examiner

*Primary Examiner*—Ramon M Barrera
(74) *Attorney, Agent, or Firm*—Oliff & Berridge PLC

(57) ABSTRACT

New and useful alignment method and system for electromagnets used in the high energy accelerator that can make the installation simple and less time consuming are disclosed. By measuring the multiple of measurement reference points for obtaining the position and posture information of the electromagnet on the high energy accelerator, the deviation of the present value from the installation target value for the electromagnet within the reference coordinates in the building. For each of the adjustment mechanisms such as the multiple of adjustment bolts or the actuators, the Jacobian matrix representing the relationship between the unit operation amount and the posture changes of the electromagnet is obtained. Then, by calculating operation amounts for each of the adjustment mechanisms through multiplication of the inverse matrix of the Jacobian matrix with the deviation, the position and posture are aligned to the target value by operating the adjustment mechanisms collectively with the calculated operation amounts.

16 Claims, 14 Drawing Sheets

| | | Horizontal Adjustment Bolt | | | | | |
|---|---|---|---|---|---|---|---|
| | | H1 | H2 | H3 | H4 | H5 | H6 |
| Vertical Adjustment Bolt (In Operation) | V1 | 5 N·m | 5 N·m | 5 N·m | 5 N·m | 5 N·m | 5 N·m |
| | V2 | 5 N·m | 5 N·m | 5 N·m | 5 N·m | 5 N·m | 5 N·m |
| | V3 | 5 N·m | 5 N·m | 5 N·m | 5 N·m | 5 N·m | 5 N·m |
| | V4 | 5 N·m | 5 N·m | 5 N·m | 5 N·m | 5 N·m | 5 N·m |

FIG.12

| | | Other Horizontal Adjustment Bolt | | | | | |
|---|---|---|---|---|---|---|---|
| | | H1 | H2 | H3 | H4 | H5 | H6 |
| Horizontal Adjustment Bolt (In Operation) | H1 | — | FREE | 5 N·m | 5 N·m | 5 N·m | 5 N·m |
| | H2 | FREE | — | 5 N·m | 5 N·m | 5 N·m | 5 N·m |
| | H3 | FREE | 5 N·m | — | FREE | 5 N·m | 5 N·m |
| | H4 | FREE | 5 N·m | FREE | — | 5 N·m | 5 N·m |
| | H5 | 5 N·m | FREE | 5 N·m | 5 N·m | — | FREE |
| | H6 | 5 N·m | FREE | 5 N·m | 5 N·m | FREE | — |

FIG.13

ALIGNMENT METHOD AND SYSTEM FOR ELECTROMAGNET IN HIGH-ENERGY ACCELERATOR

FIELD OF THE INVENTION

The present invention relates to an alignment method and an alignment system of the electromagnets used with the high-energy accelerator for adjusting the direction of proton beam by changing the position and posture of electromagnets.

BACKGROUND

The high-energy accelerator, providing high amount of kinetic energy to positrons by acceleration, is utilized in the research and medical (such as cancer treatment) fields. In this type of high-energy accelerators, such as multiple of continuous deflection electromagnets or quadrupole electromagnets are installed for the positron beam control.

The schematic of the high-energy accelerator is shown in FIG. 14. In this schematic, the positron is the subject for the acceleration. As shown in the figure, high energy beams are provided to each room 205 by passing through the synchrotron 203, multiple of beam transporting line 204 after generated by the positron generating device 202. The multiple of electromagnets such as sextupole electromagnets 206, quadrupole electromagnets 207, and deflection electromagnet 208 are installed in the synchrotron 203 and beam transporting lines 204. The number of the electromagnets depends upon the specifications and size of the high energy accelerator, however, some system has 20 or more electromagnets are installed with in. It is essential to make a precise alignment of the proton beam's actual path as designed since even a slight deflection of the circular path of the high energy accelerator 201 from the desired path will not produce high precision energy. So multiple of adjustment bolts for the electromagnets are provided for the precise position adjustment of the high beam path with the fine adjustment of the bolts.

Conventional position adjustment method follows the steps of measuring the position and posture of the electromagnets within the high energy beam transporting line relative to the reference point of the building, selecting the subjective adjustment bolts and made adjustment if the equipment is not within a certain range of the specifications. However, since the specifications, size and layout of the electromagnets became more complicates, the adjustment of one bolt largely influenced or completely no influence to the entire system. It therefore required an enormous amount of workload and time for the adjustment by repeating the trials and errors, in the adjustment utilizing the adjustment bolts that have different shape and weight respectively in complicated layouts.

It has been desired to invent the alignment method to make the electromagnets of the high energy accelerator to be on the dully position accurately with a simple way. From such a view point, the new technologies have been proposed such as described in the Japanese Laid-open publications JP1996-163197A, JP1999-214198A, and JP2000-208300A, and a Japanese Patent Number 3190923.

In the high-energy accelerator disclosed in the above references, the multiple of adjustment bolts for the electromagnets in the horizontal directions (X and Y axis) and ones for the vertical direction (Z axis) are installed and alignment has been done with them. This alignment method is adjusting the electromagnet to the predetermined position and posture by rotating the multiple of adjustment bolts that seem necessary to do so by checking the position and posture relative to the building reference point within the building.

The actual adjustments of this type have a difficulty in reality since it largely depends upon the individual experience of the operators since they make the adjustment manually. For example, whether or not a horizontal adjustment bolt should touch upon the electromagnet is not predetermined when we operate a certain vertical adjustment bolt. Even in case of the tightening, the amount of tightness is not predetermined. In case of the horizontal adjustment bolts are left free (or the tightness is small), the contact between the vertical adjustment bolt and the electromagnet is not a perfect point contact condition; the load condition of the vertical adjustment bolts supporting the electromagnet and the center of gravity of the magnet are not even; therefore, the electromagnet is shifted horizontally due to the rotation of the adjustment bolt caused by the friction force. Since the electromagnet moves unexpectedly, the alignment of it is not easy. And if horizontal adjustment bolts are too tight, the electromagnet wouldn't move at all even though the vertical adjustment bolt is turned. Further more, in case that one horizontal adjustment bolt is rotated for adjustment, same thing could happen as the aforementioned vertical adjustment bolt.

As described above, as the adjustment operation of the position and posture of the electromagnet repeat the trial and error by making small movement of the adjustment bolts to reach to the target point, the installation time of each electromagnet is deviated and unpredictable; therefore it may largely influence to the total time schedule of the accelerator construction.

It is not necessary to obtain the quantitative measurement information since the amount of the adjustment depends upon the skill of the operator. However, it is desirable to calculate each alignment amounts of the adjustment bolts quantitatively, by inputting the data obtained from the various measuring devices for improving the efficiency of the alignment operation.

In any situation, the abovementioned conventional alignment method had a problem that it required large amount of time for the adjustment operation through the trail and error since the positions and the adjustment amounts of the adjustment bolts are not precisely determined.

SUMMARY

It is therefore the objective of present invention is in order to solve the problem and to provide the alignment method and system for the electromagnets of the high energy accelerator with high precision but simple and short time installation of the electromagnets.

And other objective of the present invention is to provide the position adjustment device for the electromagnets that can deal with alignment values from a various measuring devices irrespective of the shape and size of the electromagnets for the high energy accelerator.

In this invention, in order to achieve those objectives, measuring the distances between the positions of the electromagnets of the high energy accelerator and the predetermined multiple of measuring reference points for obtaining the posture, obtain the deviations between the installation target position of the electromagnets and the current positions within the building reference coordinate axes, obtaining the relationship between the unit amount of adjustment and the changes in the posture of the electromagnet utilizing the Jacobian matrix, calculating the adjustment amount of each adjusting mechanism by multiplying the Jacobian inverse matrix and the amount of the deviation for each of the multiple of adjustment mechanisms for adjusting the position/posture of the electromagnets, and aligning the position/posture to the target value by operating the adjustment mechanisms with the calculated operation value.

By putting at least three points of the measuring reference points on the electromagnets, and measure the distances between the building reference point with a measuring device such as the three-dimensional measuring equipment, current position/posture are realized. At the same time, by obtaining the deviations between the target values and present values, the position adjustment value and the changed posture amount, as the target positions for the aforementioned measuring reference points relative to the reference position of the building has been given as the designed values. Multiple of adjustment mechanisms are provided for correcting the position and posture of the electromagnets. Generally, vertical and horizontal adjustment mechanisms are provided. A adjustment bolt with an actuator or a fluid compression device utilizing a oil pressure cylinder can be used for the adjustment mechanism.

With the adjustment mechanisms, the characteristics on how much the position and posture of the electromagnets will be influenced by applying a unit operation to each of the mechanisms. While a unit operation is conducted to each adjustment mechanism, it is desirable to restrain the movement of the electromagnet in horizontal direction by the other adjustment mechanisms when a vertical unit operation is conducted with a certain adjustment mechanism, for avoiding unwanted horizontal movement of the electromagnet, in order to obtain accurate characteristics of the trial. It should be bear in mind that the electromagnet is allowed to move in a direction moved by the adjustment mechanism that is subject to the operation, while the movements in other directions are restrained. So the restrain torque for restraining the electromagnet is predetermined, and the translation and rotation of the electromagnet are restrained by the other adjustment mechanisms. The restrain torque is to be adjusted enough value not to damage the electromagnet while restraining its movement. By doing so, the characteristic of position/posture changes with the adjustment mechanism that is subject to the operation are detected precisely. While the characteristics of each adjustment mechanism caused by the unit operation are detected respectively, changes of posture of the electromagnet in six (6) degrees of freedom are observed by the unit operation to a certain adjustment mechanism. Therefore, by selecting the changing elements of freedom that are caused by the adjustment of the specific adjustment mechanism, the Jacobian matrix showing how much posture changes are produces by the unit operation is created. At the time, certain adjustment is made not to make the matrix without redundancy.

The deviation between the present value and the target value is to be the amount of operation, and the amount of operation for each mechanism is obtained through the multiplication of the deviation with the inverse matrix of the Jacobian matrix obtained by the above step. At first, by making an adjustment in the vertical direction then followed by in the horizontal adjustment, we can make alignment of the electromagnet into the dully installation position without causing complicated calculation process. The calculation process can be done by analyzing device such as computer; and the alignment tasks are drastically improved by introducing automated adjustment process.

BRIEF DESCRIPTION OF THE DRAWINGS

FIG. 12 shows a chart indicating the torque value setting of the horizontal adjustment bots during the operation of the vertical adjustment bolts according to the third embodiment.

FIG. 13 shows a chart indicating the torque value setting of the vertical adjustment bots during the operation of the horizontal adjustment bolts according to the third embodiment.

DETAILED DESCRIPTION

Figure 1:
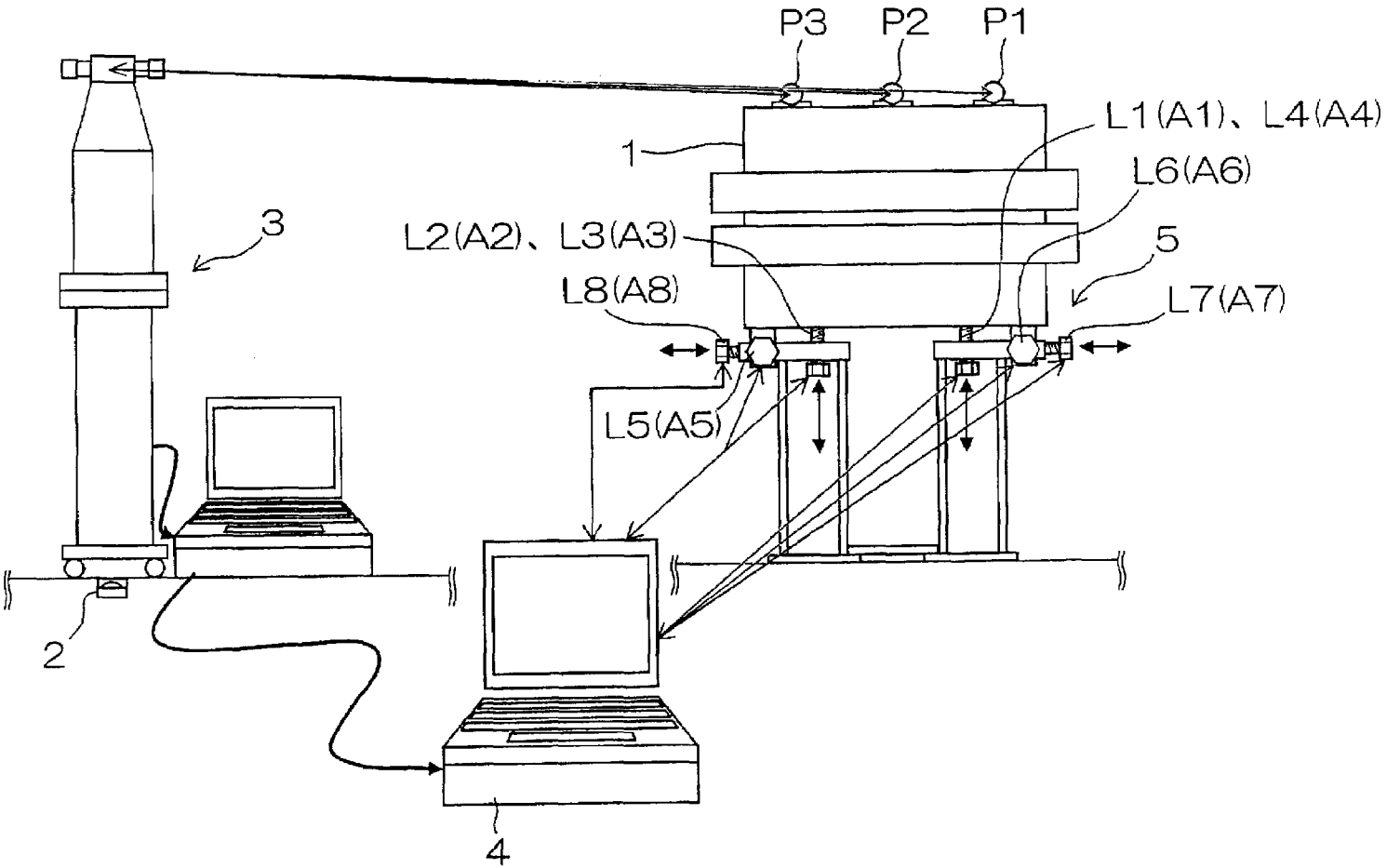
FIG. 1 is the schematic of the high-energy accelerator alignment system according to the one embodiment of the present invention.

Referring to the drawings, a comparative example and a plurality of embodiments of the present invention relating to the alignment method and the alignment system suitable for the electromagnets for the high-energy acceleration will be described below. The same reference numerals in the drawings will denote identical or equivalent components.

As FIG. 1 shows, a electromagnet 1, such as a deflective electromagnet or a quadrupole electromagnet, is provided in the high power accelerator for controlling the path of positron beam.

At the bottom of the electromagnet 1, there is an adjustment mechanism 5 for adjusting the position and posture of the electromagnet 1. The adjustment mechanism 5 is provided with the adjustment bolts L1, L2, L3 and L4 located at the four bottom corners of the electromagnet 1 for adjusting the position of the electromagnet 1 in the vertical direction (direction Z), and the adjustment bolts L5, L6, L7 and L8 located at the four bottom ends of front and rear ends along with the Y axis direction of the electromagnet 1 for adjusting the position of the electromagnet 1 in the horizontal directions (direction X and Y). Additionally, the adjustment bolts L5' and L6' facing in the opposite direction are provided on the other sides (Not shown).

Each adjustment bolt L1-L8 has the actuator A1-A8 (not shown) such as a motor respectively, and the adjustment bolt is rotated by the actuator. Since the adjustment bolts L5' and L6' also has the actuators, there are total of 10 actuators in this unit. There are also three measurement reference points P1, P2 and P3 at the corner of a triangle located on the top of the electromagnet 1.

At the certain place within a building enclosing the high energy accelerator, there is the measurement reference point 2; and there is a three-dimensional measuring equipment (hereinafter refer as "the measuring equipment") 3 that is located on the measurement reference point 2 will measure the objects (such as measurement reference points P1, P2 and P3 in this embodiment) with a laser etc. The measuring equipment 3 is connected with the analyzing device 4 that is located either nearby or outside of the building. The analyzing device 4 is also connected with the actuator A1-A8 and controls their movements.

Next, how to calculate the adjustment amounts separated in the vertical and horizontal directions of the electromagnet 1 is explained below. By giving a fixed amount of movement to one of the adjustment bolts L1-L8, the posture of the electromagnet makes a consistent change. By observing these changes, the movement of the adjustment bolt L1-L8 creates a repeatable posture change in the electromagnet 1. Thus we can express the relationship in a form of the matrix equation.

In the X, Y and Z axes defined in the building, the movement amount to the duly designated position for the electromagnet is expressed as:

(X, Y, Z, θx, θy, θz ), where the vertical and horizontal translations are X, Y and Z, and the rotational angles are θx, θy, θz. Then the adjustment operation amount for each adjustment bolt L1-L8 is determined by the general inverse matrix of the above matrix.

More detailed explanation is as follows:

First, define the coordinate value of the three measuring position P1, P2, P3 and P4 defined by the design and the center of gravity of the three positions as G as follows:

$P_1=(x_1, y_1, z_1)$ $P_2=(x_2, y_2, z_2)$ $P_3=(x_3, y_3, z_3)$ $G=(x_1+x_2+x_3, y_1+y_2+y_3, z_1+z_2+z_3)/3=(x_g, y_g, z_g)$

And the current positions of the three measure points and the center of gravity as follows:

$P_{10}=(x_{10}, y_{10}, z_{10})$ $P_{20}=(x_{20}, y_{20}, z_{20})$ $P_{30}=(x_{30}, y_{30}, z_{30})$ $G_0=(x_{10}+x_{20}+x_{30},\ y_{10}+Y_{20}+Y_{30},\ z_{10}+z_{20}+z_{30})/3=(x_{g0}, y_{g0}, z_{g0})$

Then, the deviations between target and current positions are:

$$(dx_g, dy_g, dz_g)=G_0-G=(x_{g0}-x_g, y_{g0}-y_g, z_{g0}-z_g) \tag{1}$$

These are the definitions of parallel move components of the electromagnet. Next, the expression of the rotational move components is explained. We initially define the unit vector $i_0$ in the direction parallel to the bottom line of the triangle defined by measured value of the three measuring point, the unit vector $j_0$ in the vertical direction to the bottom line and toward to the apex of the triangle, and the unit vector $k_0$ in the orthogonal direction to the other two unit vectors and perpendicular to the plane defined by the triangle. These vectors in the X, Y and Z-axes in the building are expressed as 3 rows×3 columns rotation matrix A:

$$E=A[i_0\ j_0\ k_0]$$

In this equation E is a unit matrix. Therefore, A becomes:

$$A=[i_0\ j_0\ k_0]^{-1}E$$

Assume the amount of rotation about each axis is minute, the rotation matrix is approximated to the following expression; and by comparison with the each component of the result of the calculation, the rotation amounts $\theta_{xg0}$, $\theta_{yg0}$, $\theta_{zg0}$ are identifies.

$$A=\begin{bmatrix} 1 & \theta_{zg0} & -\theta_{yg0} \\ -\theta_{zg0} & 1 & \theta_{xg0} \\ \theta_{yg0} & -\theta_{xg0} & 1 \end{bmatrix} \tag{2}$$

Further, by calculating the unit orthogonal vectors i, j, k of the electromagnet, likewise as explained above, and obtaining the angles of target position ($\theta_{xg}$, $\theta_{yg}$, $\theta_{zg}$) coordination of the electromagnet relative to the reference coordination of the building, then the rotational components to be applied to the electromagnet for the purpose of posture alignment are defined by subtracting the current value from the target value: the angles between these values relative to the reference coordination:

$$(d\theta_{xg}, d\theta_{yg}, d\theta_{zg})=(\theta_{xg0}-\theta_{xg}, \theta_{yg0}-\theta_{yg}, \theta_{zg0}-\theta_{zg}) \tag{3}$$

In this alignment method, the posture changes are expressed by three translation components in the expression (1) and three rotational components in the expression (3).

Under these premises, the alignment in the vertical direction is conducted by three adjustment bolts (L1, L2, and L3) by selectively removing one of the four vertical volts. This is to be done for avoiding redundancy system.

Firstly, the relationship between the axial movement and a change in the posture of the electromagnet is obtained (Jacobian Matrix). While the magnate will move in six degrees of freedom by operating the bolt, we will focus on the values of $z_g$, $\theta_{xg}$, $\theta_{yg}$ only. When utilizing the Jacobian matrix J (the first term in the right side value in the equation below) for the three bolts, the following matrix will is obtained for expressing the changes in the posture of the electromagnet relative to the operation on the bolt:

$$\begin{bmatrix} dz_g \\ d\theta_{xg} \\ d\theta_{yg} \end{bmatrix}=\begin{bmatrix} \frac{\Delta z_{g1}}{\Delta L_1} & \frac{\Delta z_{g2}}{\Delta L_2} & \frac{\Delta z_{g3}}{\Delta L_3} \\ \frac{\Delta\theta_{xg1}}{\Delta L_1} & \frac{\Delta\theta_{xg2}}{\Delta L_2} & \frac{\Delta\theta_{xg3}}{\Delta L_3} \\ \frac{\Delta\theta_{yg1}}{\Delta L_1} & \frac{\Delta\theta_{yg2}}{\Delta L_2} & \frac{\Delta\theta_{yg3}}{\Delta L_3} \end{bmatrix}\begin{bmatrix} dL_1 \\ dL_2 \\ dL_3 \end{bmatrix}=J(X_1)\begin{bmatrix} dL_1 \\ dL_2 \\ dL_3 \end{bmatrix} \tag{4}$$

Therefore, necessary bolt operation amounts obtained by multiplying the Jacobean inverse matrix and positional changes (Difference between the target and present value):

$$\begin{bmatrix} dL_1 \\ dL_2 \\ dL_3 \end{bmatrix}=J(X_1)^{-1}\begin{bmatrix} dz_g \\ d\theta_{xg} \\ d\theta_{yg} \end{bmatrix}=\begin{bmatrix} \frac{\Delta z_{g1}}{\Delta L_1} & \frac{\Delta z_{g2}}{\Delta L_2} & \frac{\Delta z_{g3}}{\Delta L_3} \\ \frac{\Delta\theta_{xg1}}{\Delta L_1} & \frac{\Delta\theta_{xg2}}{\Delta L_2} & \frac{\Delta\theta_{xg3}}{\Delta L_3} \\ \frac{\Delta\theta_{yg1}}{\Delta L_1} & \frac{\Delta\theta_{yg2}}{\Delta L_2} & \frac{\Delta\theta_{yg3}}{\Delta L_3} \end{bmatrix}^{-1}\begin{bmatrix} dz_g \\ d\theta_{xg} \\ d\theta_{yg} \end{bmatrix} \tag{5}$$

Secondary, the horizontal alignment can be conducted. Therefore, once the horizontal and height adjustment for the electromagnet is completed then movement within the horizontal directions can be made.

Same as the vertical alignment, the relationship (Jacobian matrix) between the axial movement of each bolt and the change in the posture of the electromagnet is obtained first. The operation of a bolt creates the posture changes in six degrees of freedom, however, primary factors $x_g$, $y_g$, $\theta_{zg}$ are observed mainly.

In the horizontal directions, the Jacobian matrix is obtained for four bolts $L_5$ through $L_8$.

In case of X axis adjustment, complementary movements are assumed to be applied to the bolts $L_5'$, $L_6'$ (not shown) that are located opposite side of $L_5$, $L_6$ (the rear side movements are the opposite to those of front side) in terms of the movement of the electromagnet. However, in case of Y axis adjustment bolts $L_7$ and $L_8$ that are located relatively far apart, each behavior characteristics are observed since there is delicate difference in the movement. Therefore, the behavior expressed in Jacobian matrix is expressed in the following equation (6):

$$\begin{bmatrix} dx_g \\ dy_g \\ d\theta_{zg} \end{bmatrix} = \begin{bmatrix} \frac{\Delta x_{g5}}{\Delta L_5} & \frac{\Delta x_{g6}}{\Delta L_6} & \frac{\Delta x_{g7}}{\Delta L_7} & \frac{\Delta x_{g8}}{\Delta L_8} \\ \frac{\Delta y_{g5}}{\Delta L_5} & \frac{\Delta y_{g6}}{\Delta L_6} & \frac{\Delta x_{g7}}{\Delta L_7} & \frac{\Delta x_{g8}}{\Delta L_8} \\ \frac{\Delta \theta_{zg5}}{\Delta L_5} & \frac{\Delta \theta_{zg6}}{\Delta L_6} & \frac{\Delta \theta_{zg7}}{\Delta L_7} & \frac{\Delta \theta_{zg8}}{\Delta L_8} \end{bmatrix} \begin{bmatrix} dL_5 \\ dL_6 \\ dL_7 \\ dL_8 \end{bmatrix} = J(X_2) \begin{bmatrix} dL_5 \\ dL_6 \\ dL_7 \\ dL_8 \end{bmatrix} \tag{6}$$

However, the inverse matrix is not obtainable since the above Jacobian matrix is consisting of 3 rows×4 columns. Therefore, the amounts for the bolt operations are obtained by the generalized inverse matrix method by modifying the above equation.

$$\begin{bmatrix} dL_5 \\ dL_6 \\ dL_7 \\ dL_8 \end{bmatrix} = J(X_2)^T * (J(X_2) * J(X_2)^T)^{-1} * \begin{bmatrix} dx_g \\ dy_g \\ d\theta_{xg} \end{bmatrix} \tag{7}$$

The above description is the principal of the adjustment method.

Based upon the principal, the calculation method for the amounts of adjustments in the vertical direction for each adjustment bolts L1 through L3 is explained in this embodiment of the present invention.

Before the measurement, a certain vertical bolt (choose L4 in this case) is released from the electromagnet.

Each coordinates of the measurement reference points P1, P2 and P3 are acquired to the analyzing equipment 4 as P1: $P_{10}=(x_{10}, y_{10}, z_{10})$, P2: $P_{20}=(x_{20}, y_{20}, z_{20})$, and P3: P30=(x30, y30, z30). The adjustment bolt L1 is lifted upwardly by driving the actuator A1 by a unit operational amount of 0.5 mm.

The new coordinates of the measurement reference points P1, P2 and P3 after the analyzing equipment 4 acquires the change in posture of the electromagnet 1:

P1: $P_{11}=(x_{11}, y_{11}, z_{11})$
P2: $P_{21}=(x_{21}, y_{21}, z_{21})$
P3: $P_{31}=(X_{31}, y_{31}, z_{31})$

Based upon the acquired coordinates of the measurement reference points P1, P2 and P3, the analyzing equipment 4 calculates the position change amount $G_1=(z_{g1}, \theta x_{g1}, \theta y_{g1})$ from the original center of gravity $G_0$ of $P_{10}$, $P_{20}$, $P_{30}$, where the center of gravity G obtained from the coordinates of the three reference points is given as a tentative reference point. After the calculation, the adjustment bolt L1 is moved in reverse direction by 0.5 mm, the electromagnet 1 is reset to the original position.

After L1 is reset, then the coordinates $P_{10}$, $P_{20}$, $P_{30}$ of the reference points P1, P2 and P3 are acquired once again by the analyzing equipment 4.

Now, the adjustment bolt L2 is lifted upwardly by driving the actuator A2 by a unit operational amount of 0.5 mm in the same way as above.

The new coordinates of the measurement reference points P1, P2 and P3 after the analyzing equipment 4 acquires the change in posture of the electromagnet 1:

P1: $P_{12}=(x_{12}, y_{12}, z_{12})$
P2: $P_{22}=(x_{22}, y_{22}, z_{22})$
P3: $P_{32}=(x_{32}, y_{32}, z_{32})$

From the newly acquired coordinates of the measurement reference points P1, P2 and P3, the analyzing equipment 4 calculates the position change amount $G_2=(z_{g2}, \theta x_{g2}, \theta y_{g2})$ from the position change in the center of gravity G before and after the unit operation. After the calculation, the adjustment bolt L2 is moved in reverse direction by 0.5 mm, the electromagnet 1 is reset to the original position.

After L2 is reset, then the coordinates $P_{10}$, $P_{20}$, $P_{30}$ of the reference points P1, P2 and P3 are acquired once again by the analyzing equipment 4.

The adjustment bolt L3 is lifted upwardly by driving the actuator A3 by a unit operational amount of 0.5 mm in the same way as above.

The new coordinates of the measurement reference points P1, P2 and P3 after the analyzing equipment 4 acquires the change in posture of the electromagnet 1:

P1: $P_{13}=(x_{13}, y_{13}, z_{13})$
P2: $P_{23}=(x_{23}, y_{23}, z_{23})$
P3: $P_{33}=(x_{33}, y_{33}, z_{33})$

From the newly acquired coordinates of the measurement reference points P1, P2 and P3, the analyzing equipment 4 calculates the position change amount $G_3=(z_{g3}, \theta x_{g3}, \theta y_{g3})$ from the position change in the center of gravity G before and after the unit operation. After the calculation, the adjustment bolt L3 is moved in reverse direction by 0.5 mm, the electromagnet 1 is reset to the original position.

After L3 is reset, then the coordinates $P_{10}$, $P_{20}$, $P_{30}$ of the reference points P1, P2 and P3 are acquired once again by the analyzing equipment 4.

As explained above, the change of posture of the electromagnet 1 after the predetermined amount of movement (0.5 mm) to each of the adjustment bolt L1, L2 and L3 are expressed as follows:

G1 $(z_{g1}, \theta x_{g1}, \theta y_{g1})$
G2 $(z_{g2}, \theta x_{g2}, \theta y_{g2})$
G3 $(z_{g3}, \theta x_{g3}, \theta y_{g3})$ And the Jacobian relationship J ($X_1$) is expressed in the following equation:

$$J(X_1)=\begin{bmatrix} \frac{\Delta z_{g1}}{\Delta L_1} & \frac{\Delta z_{g2}}{\Delta L_2} & \frac{\Delta z_{g3}}{\Delta L_3} \\ \frac{\Delta \theta_{xg1}}{\Delta L_1} & \frac{\Delta \theta_{xg2}}{\Delta L_2} & \frac{\Delta \theta_{xg3}}{\Delta L_3} \\ \frac{\Delta \theta_{yg1}}{\Delta L_1} & \frac{\Delta \theta_{yg2}}{\Delta L_2} & \frac{\Delta \theta_{yg3}}{\Delta L_3} \end{bmatrix} \tag{8}$$

The amount of adjustment to the adjustment bolts L1, L2, and L3 are obtained by the calculation of the inverse matrix of the above Jacobian matrix. The solutions are obtained for three adjustment bolts. Namely, the amount of adjustment ($dL_1$ through $dL_3$) for each of the adjustment bolts L1 through L3 is obtained by the following equation:

$$\begin{bmatrix} dL_1 \\ dL_2 \\ dL_3 \end{bmatrix} = J(X_1)^{-1}\begin{bmatrix} dz_g \\ d\theta_{xg} \\ d\theta_{yg} \end{bmatrix} = \begin{bmatrix} \frac{\Delta z_{g1}}{\Delta L_1} & \frac{\Delta z_{g2}}{\Delta L_2} & \frac{\Delta z_{g3}}{\Delta L_3} \\ \frac{\Delta \theta_{xg1}}{\Delta L_1} & \frac{\Delta \theta_{xg2}}{\Delta L_2} & \frac{\Delta \theta_{xg3}}{\Delta L_3} \\ \frac{\Delta \theta_{yg1}}{\Delta L_1} & \frac{\Delta \theta_{yg2}}{\Delta L_2} & \frac{\Delta \theta_{yg3}}{\Delta L_3} \end{bmatrix}^{-1} \begin{bmatrix} dz_g \\ d\theta_{xg} \\ d\theta_{yg} \end{bmatrix} \tag{9}$$

Next, the calculation of the adjustment amounts for each adjustment bolts L5 through L8 is explained below.

The calculation of the adjustment amounts for the adjustment bolts L5 through L8 is the same way as the adjustment bolts L1 through L4. The adjustment bolts L5 through L8 are moved by a unit operation amount (for example 0.5 mm) by the actuators A5 through A8.

From the acquired coordinates of the measurement reference points P1, P2 and P3 before and after the unit operation, the position change amounts of the electromagnet with respect to the adjustment bolts L5 through L8 relative to the tentative reference point of the center of gravity G are calculated as G5 ($x_{g5}$, $y_{g5}$, $\theta z_{g5}$) , G6 ($x_{g6}$, $y_{g6}$, $\theta z_{g6}$), G7 ($x_{g7}$, $y_{g7}$, $\theta z_{g7}$), and G8 ($x_{g8}$, $y_{g8}$, $\theta z_{g8}$).

From these parameters, the Jacobian relationship J ($X_2$) is expressed in the following equation:

$$J(X_2)=\begin{bmatrix} \frac{\Delta x_{g5}}{\Delta L_5} & \frac{\Delta x_{g6}}{\Delta L_6} & \frac{\Delta x_{g7}}{\Delta L_7} & \frac{\Delta x_{g8}}{\Delta L_8} \\ \frac{\Delta y_{g5}}{\Delta L_5} & \frac{\Delta y_{g6}}{\Delta L_6} & \frac{\Delta x_{g7}}{\Delta L_7} & \frac{\Delta x_{g8}}{\Delta L_8} \\ \frac{\Delta \theta_{zg5}}{\Delta L_5} & \frac{\Delta \theta_{zg6}}{\Delta L_6} & \frac{\Delta \theta_{zg7}}{\Delta L_7} & \frac{\Delta \theta_{zg8}}{\Delta L_8} \end{bmatrix} \tag{10}$$

The amounts of adjustment to the adjustment bolts L5, through L8 are obtained by the calculation of the generalized inverse matrix of the above Jacobian matrix. The adjustment amounts ($dL_5$ through $dL_8$) for the adjustment bolts L5 through L8 with respect to the target values are obtainable by calculating the following equation:

$$\begin{bmatrix} dL_5 \\ dL_6 \\ dL_7 \\ dL_8 \end{bmatrix} = J(X_2)^T * (J(X_2) * J(X_2)^T)^{-1} * \begin{bmatrix} dx_g \\ dy_g \\ d\theta_{xg} \end{bmatrix} \tag{11}$$

Figure 3:
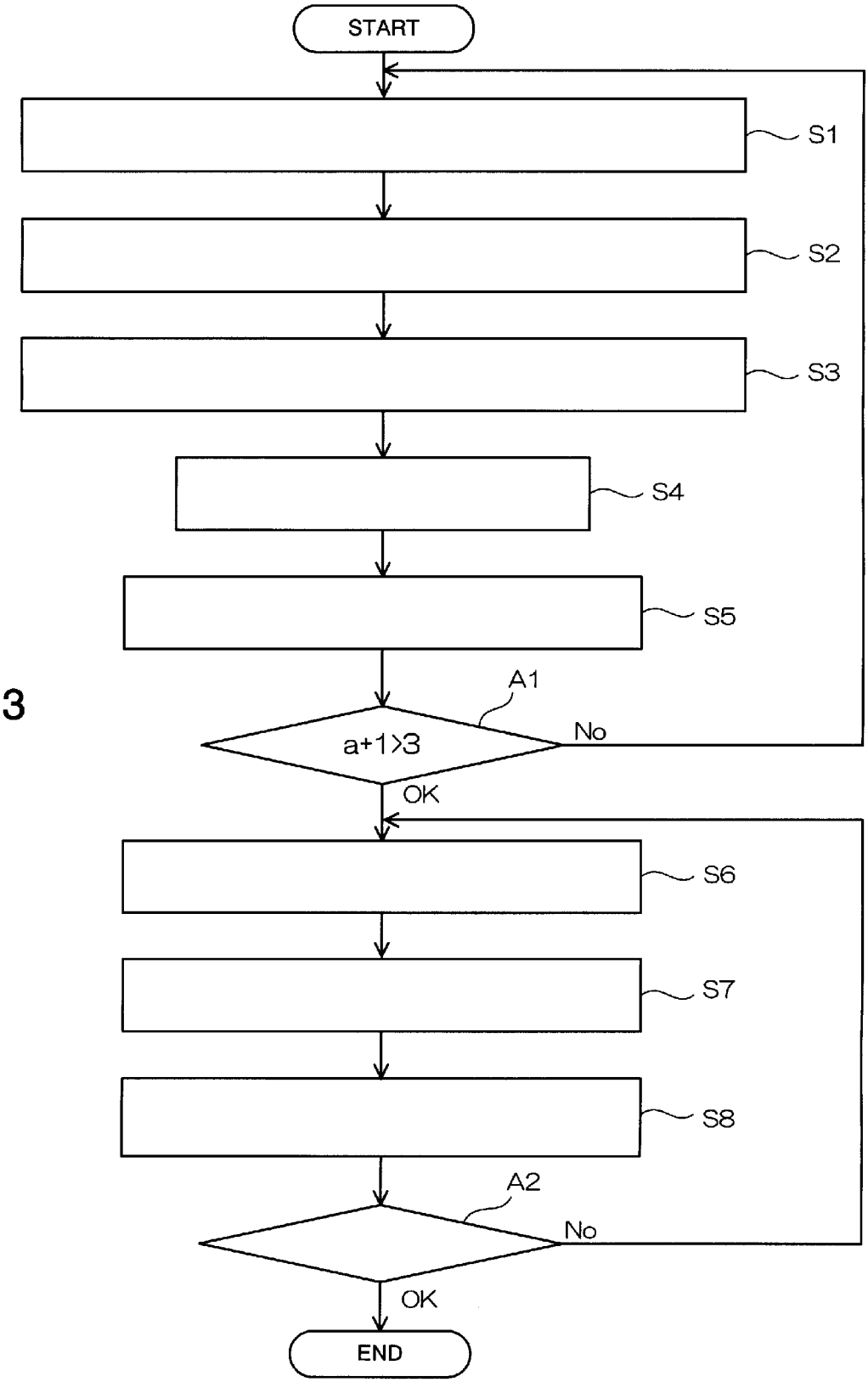
FIG. 3 shows a process flowchart relating the vertical alignment method according to the embodiment of the invention.

Referring the FIG. 3, the operational flow of the vertical alignment system for the electromagnet for the high energy accelerator according to the present invention is explained.

After the system is initiated, the coordinates of the measurement reference points P1, P2 and P2 relative to the reference point 2 are measured by the three-dimensional measuring device 3 shown in the FIG. 1 and transmitted the data to the analyzing equipment 4 as P1: $P_{10}$ ($x_{10}$, $y_{10}$, $z_{10}$), P2: $P_{20}$ ($x_{20}$, $y_{20}$, $z_{20}$), and P3: $P_{30}$ ($x_{30}$, $y_{30}$, $z_{30}$) respectively. (As indicated as the Step S1 in FIG. 3)

After the acquisition of the data, the adjustment bolt La is moved by the actuator Aa by a predetermined amount (such as 0.5 mm), where a=1 as a initial value. Namely, at the first time, the adjustment bolt L1 (a=1) is moved by the actuator A1 (a=1). (As indicated the Step S2)

The coordinates of the measurement reference points P1, P2 and P2 relative to the reference point 2 are measured by the measuring device 3 and transmitted the data to the analyzing equipment 4 as P1: $P_{1a}$($x_{1a}$, $y_{1a}$, $z_{1a}$), P2: $P_{2a}$($x_{2a}$, $y_{2a}$, $z_{2a}$), and P3: $P_{3a}$($x_{3a}$, $y_{3a}$, $z_{3a}$) respectively, where a is the same valuable as indicated the step S2 starting a=1. At the initial value a=1, the first coordinates are P1: $P_{11}$($x_{11}$, $y_{11}$, $z_{11}$), P2: $P_{21}$($x_{21}$, $y_{21}$, $z_{21}$), and P3: $P_{31}$($x_{31}$, $y_{31}$, $z_{31}$) respectively. (As indicated as the Step S3)

By comparing the coordinates of the measurement reference points P1, P2 and P3 obtained by the analyzing equipment 4 with the step S1 and the new coordinates of the measurement reference points P1, P2 and P3 obtained by the analyzing equipment 4 with the step S3, the position change amount Ga (where a is the same valuable as the step 2 and the initial value a=1) relative to the tentative reference point of the center of gravity G is calculated. (Indicated as step 4). The first position change amount obtained is G1. (As indicated as Step 4)

After the calculation, by driving the actuator Aa (the first one is A1) in the reverse direction by the same predetermined amount (such as 0.5 mm), the position of the electromagnet 1 is reset to the original position. (As indicated as Step 5)

After finishing the Step 5, add 1 to a (process the counter a=a+1) then check if a+1>3 or not. If it is not the case ("No" in FIG. 3), the process will go back to Step S1 and repeat the same sequence. When a+1>3 ("OK" in FIG. 3), then this repetition is completed and goes to the next step (S6) as indicated below. That means, all the Step 1 through Step 5 are competed to each of the adjustment bolt L1 through L8 before goes to the next step (S6) to be explained below. (As indicated as the Judgment Step A1).

From the calculated position change amounts of the adjustment bolts L1 through L8, the generalized inverse matrix of the Jacobian matrix is calculated, and then the each adjustment amount for each adjustment bolt L1 through L8 is calculated. (Step S6)

According to the adjustment amounts, the actuators A1 through A3 corresponding to the adjustment bolts L1 through L3 are activated to move the bolt head of the adjustment bolt L1 through L3. (Step S7)

Then by using the three-dimensional measuring device 3, the measurement reference points P1, P2 and P3 are measured again for obtaining the coordinates relative to the reference point 2. (Step S8)

By checking the coordinates obtained from the Step 8, the judgment is made if the electromagnet 1 has been translated to the desired position. If the position of the electromagnet 1 is not reached the duly position ("No" in the FIG. 3), it goes back to Step S6 in order to make a new adjustment. When it is deemed that the electromagnet 1 has reached to the desired position ("OK" in the FIG. 3), the adjustment operation goes to the end. (The Judgment Step A2).

After finishing the vertical alignment, almost the same steps will be repeated for the horizontal adjustment by using the adjustment bolts L5 through L8. In this case, the Jacobian's generalized inverse matrix is used in stead of the inverse matrix. The explanation above with reference to FIG. 3 can be understood in case of a=5 through 8 and the label in the Judgment Step A1 is replaced with a+1>8 in the case of the horizontal alignment As explained above, the alignment method and the alignment system for the electromagnet in the high energy accelerator according to the present invention clearly define the positions of the necessary adjustment bolts and their adjustment amounts for the alignment of the electromagnet, and can provide the shorter time and simple operation for the alignment operation of the electromagnet.

It should be born in mind that the adjustment operation for the adjustment bolts L1 through L8 can be done manually while the adjustment bolts L1 through L8 are driven by the actuators A1 through A8 in this preferred embodiment.

In case that the adjustment bolts L1 through L8 are manually adjusted after the calculation of the adjusted amounts for the adjustment bolts L1 through L8, it can be done in a way that the calculated adjustment amounts are informed to the operator who makes the adjustment while the coordinates of the measuring reference P1, P2 and P3 are acquired regularly (with a constant interval) by the analyzing equipment 4 and the new adjustment amounts based upon the newly acquired coordinates data are calculated.

Now, the second preferred embodiment is explained. In this embodiment, the actuators are used directly for the adjustment instead of using the adjustment bolts according to the abovementioned preferred embodiment.

Figure 4:
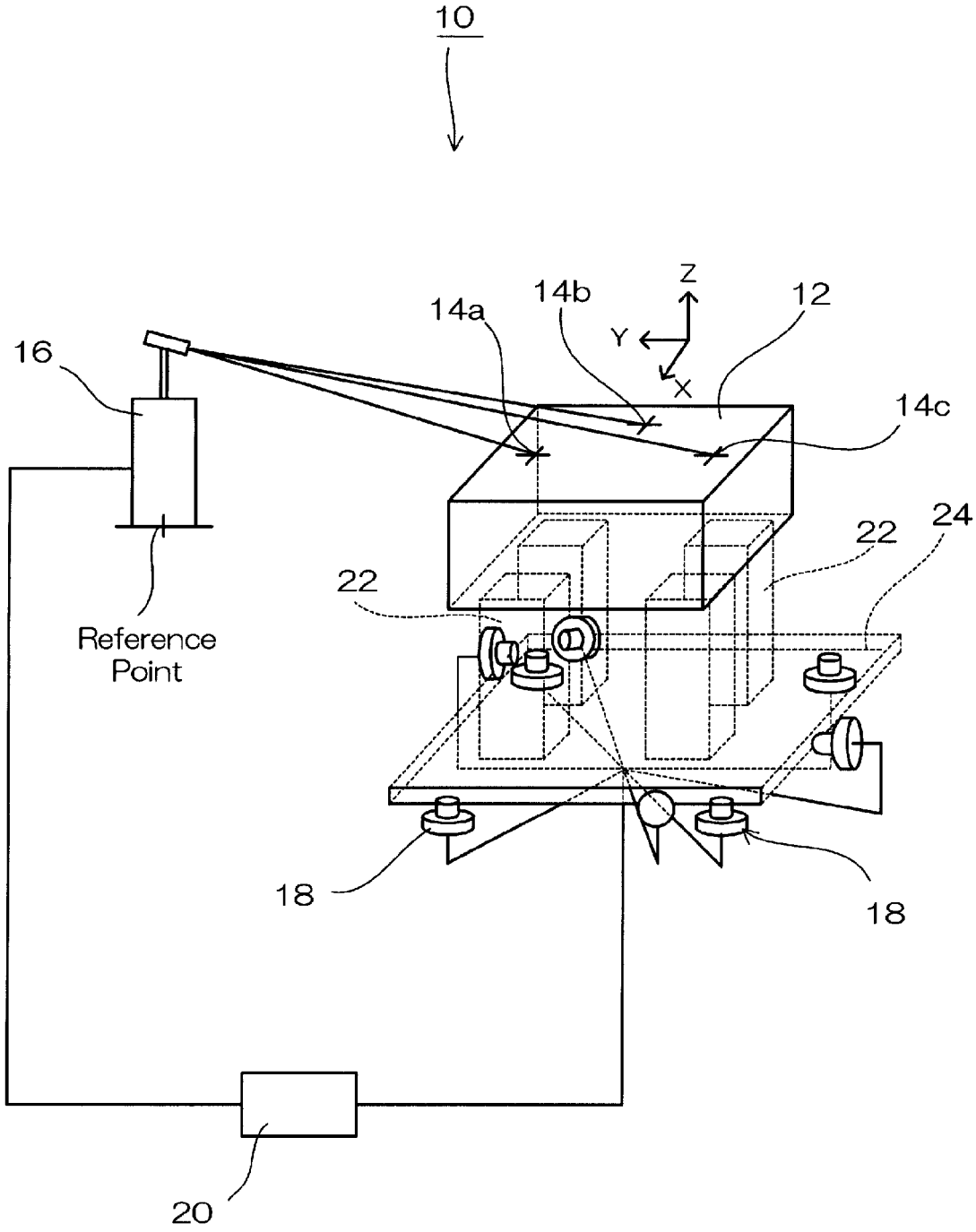
FIG. 4 shows a schematic of the high energy accelerator alignment system according to the second embodiment of the present invention.

FIG. 4 shows the schematic showing general construction of the second preferred embodiment relating to the alignment system for the electromagnet in the high-energy accelerator.

The alignment system 10 comprising the measurement device 16 for measuring the three-dimensional position information of the three measurement points 14*a*, 14*b* and 14*c* on the electromagnet 12 in the beam transmitting line, actuators 18 consisting of the fluid cylinder mechanism for making the displacement adjustment for the electromagnet 12, and the analyzing equipment 20 for calculating the amount of displacement in three dimension based upon the measured values from the measuring means and predetermined install position information, as basic elements.

Figure 2:
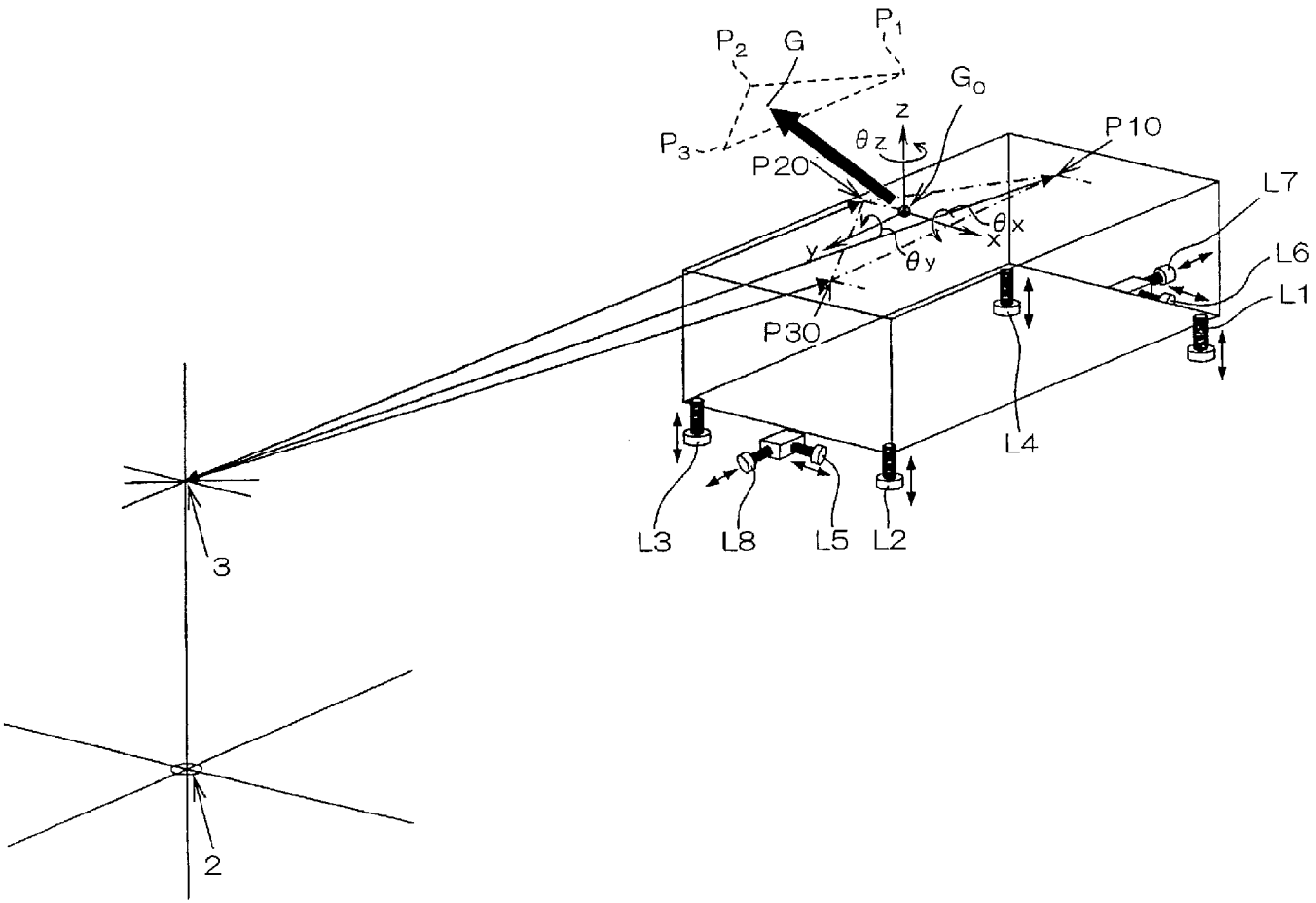
FIG. 2 is a schematic for explaining the measurement and how to obtain the adjustment amount with the three-dimensional measuring device.
Figure 5:
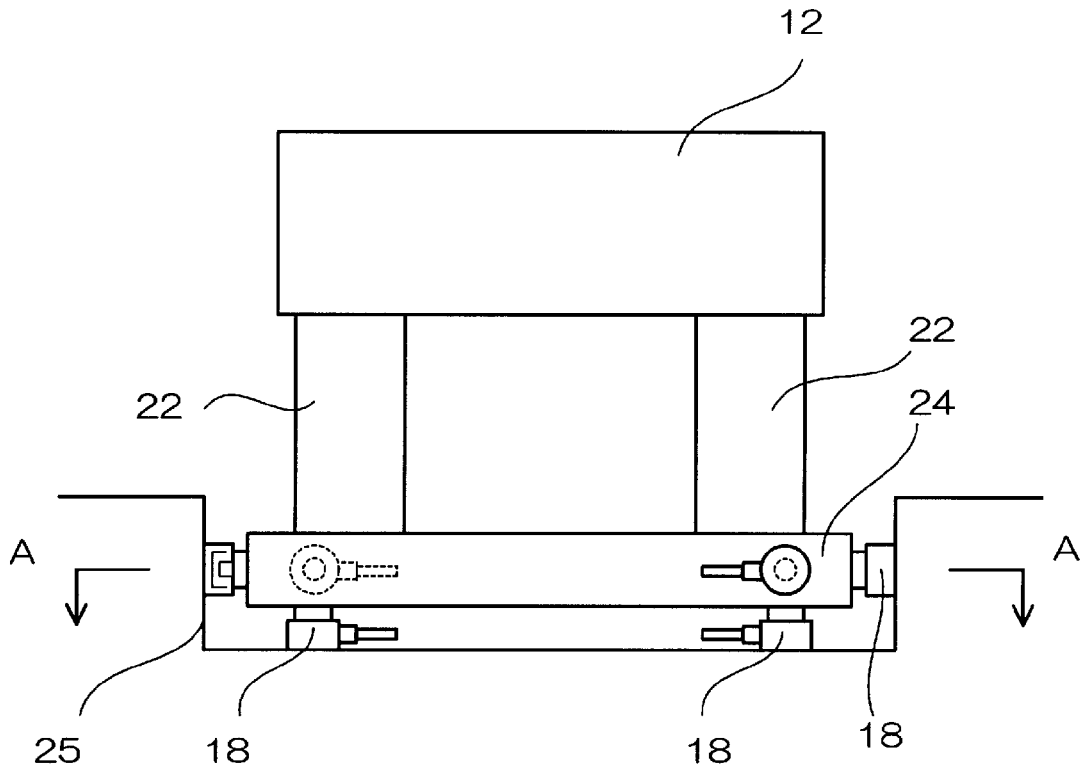
FIG. 5 shows measuring positions of the electromagnets of the second embodiment.
Figure 6:
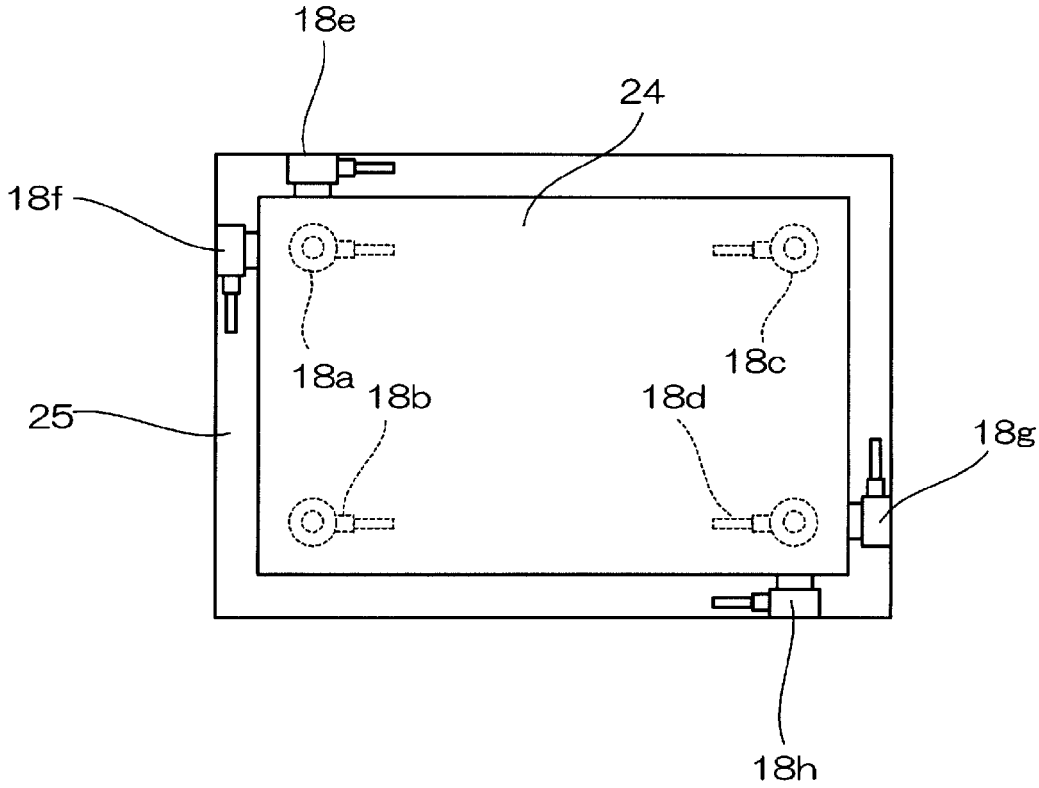
FIG. 6 shows a schematic of the configuration layout of the actuators of the second embodiment.

Multiple of electromagnets 12 are installed in the beam transmission line of the accelerator. The electromagnets 12 can be deflection electromagnets, sextupole electromagnets, and quadrupole electromagnets or the like. Under the electromagnet 12, four supporting columns supporting the electromagnets form the mount portion 22. Underneath the mount portion 22, the base portion 24 for supporting the mount portion is located. On the top of the electromagnet 12, there are predetermined three measurement reference points 14*a*, 14*b*, and 14*c* same as the first embodiment (P1, P2 and P3 in FIG. 2), and the position and posture information are obtained by the three-dimensional measurement device 15 as explained later. As indicated in FIGS. 5 and 6, the base portion 24 is installed within the pit shaped installation flame 25 located in the beam transmitting line. The base portion 24 to support the electromagnet 12 is formed in rectangular shape, and installed within the installation frame 25 that is one size bigger than that of the base portion 24 temporarily. The three-dimensional coordinated positions of the three points 14*a*, 14*b* and 14*c* of the electromagnet 12 are predetermined by the design as the target installation positions.

As the measurement means, three-dimensional measuring device 16 such as laser measuring device can be used. The laser-measuring device has the angular sensor and applies the laser beam on to the reflection panels located at the measuring positions. Then the angular sensor measures the irradiation angles of the laser beam. At the same time, the irradiation distances are measured from the reflected laser beam reflected from the reflection panels. Through this device, three-dimensional coordinated positions of the electromagnet 12 are measured and the measured data are transmitted to the analyzing device 20 that will be explained below. The measurement device 16 measures the position of the three measurement reference points 14*a*, 14*b* and 14*c* on the electromagnet 12.

FIGS. 5 and 6 is the schematics showing the construction layout of the actuators. FIG. 5 shows the side view and the FIG. 6 is the cross-section diagram of the A-A separation line. As shown in the drawings, the multiple of actuators 18 are located on the bottom and sides in between the base portion 24 and the installation frame 25. In this preferred embodiment, four of the actuators 18*a*, 18*b*, 18*c*, and 18*d* are located at the four corners of the bottom of the base portion 24 for the operation in the vertical direction. There are a couple of two actuators located in each opposite corner in the diagonal line of the base portion 24 that push the orthogonal sidewall surfaces. There are actuators 18*e*, 18*f*, 18*g*, and 18*h* are located in between the four side surfaces and the installation frame 25 for the operation in the horizontal directions. Depending upon the size of the electromagnet 12, the actuators 18*a* through 18*h* can be chosen either the electric or fluid (oil) driven system or other forms, and desirably can perform the 0.1 mm unit minute adjustment response.

It is suitable to design the movements of the couple of opposite actuators (18*e* and 18*h*, and 18*f* and 18*g*) to synchronize their movement so as to make the amounts of forward and backward movements the same, for the actuators 18*e* through 18*h* located in the sides. For example, it is possible to make one actuator 18*e* is in operation, the other actuators 18*f* through 18*h* should be no load condition, so that the actuator 18*e* can expand and contract feely without the influence of the other actuators 18*f* through 18*g* and move the electromagnet. On the contrary, the actuators 18*a* through 18*d* can move the electromagnet 12 without influenced by the other actuators even it is activated alone.

In this embodiment, eight (8) actuators for the sides and bottom of the base portion 24 are used and deployed. However, the number of the actuators 18 is not limited to this number. For example by putting the multiple of the actuators 18 are placed one side and total number can be four (4) or more, and other modification and design changes are selectable discretionally based upon the subject of installation such as size of the electromagnet and its shape.

The actuators 18*a* through 18*d* located at the bottom of the four corners of the base portion 24 can move the electromagnet 12 up and down (z direction) and also rotate about the axes of x axis and y axis (θx, θy ). The actuators 18*e* through 18*h* can move the electromagnet 12 forward and backward (x axis direction), left and right (y direction), also rotate about the z axis (θz ). By utilizing these actuators, the electromagnet 12 can be mover any three-dimensional directions.

The analyzing equipment 20 is connected to the measuring device 16 and the actuators 18 for their driving control. It include the construction of the operational processor portion for processing the behavior characteristics of the electromagnet 12 caused by the movement of the multiple of the actuators 18, and the second calculation processor portion that calculate the amount of adjustment movement of the electromagnet 12 from the measured position to the defined position.

The operating process of the analyzing equipment 20 is the same as the first preferred embodiment. The three-dimensional coordinates date of the measurement reference points 14*a* through 14*c* relative to the building reference point as the origin are stored in the memory, so the three-dimensional measurement device 16 located on the building reference point measures the current position and posture of the electromagnet 12. After that, the tentatively positioned electromagnet 12 is precisely and quickly to the target position by sequentially process each steps described in FIG. 3. Namely, each of mutiple actuators for changing the position and posture of the electromagnet 12 is moved by a unit operation amount individually. At the time, except for the actuator that is subject to the operation, other actuators are not operated, and the movements of the actuators other than those allows lateral and rotational movements caused by the actuator in operation are restricted to the base portion 24. By expanding to a Jacobian matrix, and obtaining the generalized inverse matrix of the Jacobian matrix with the previously obtained current deviation value of the electromagnet 12 from the target value, the necessary amount of the operation can be obtained for eliminating the deviation. This type of process is the same as the first embodiment that follows the equations (1) through (11) described above.

Figure 7:
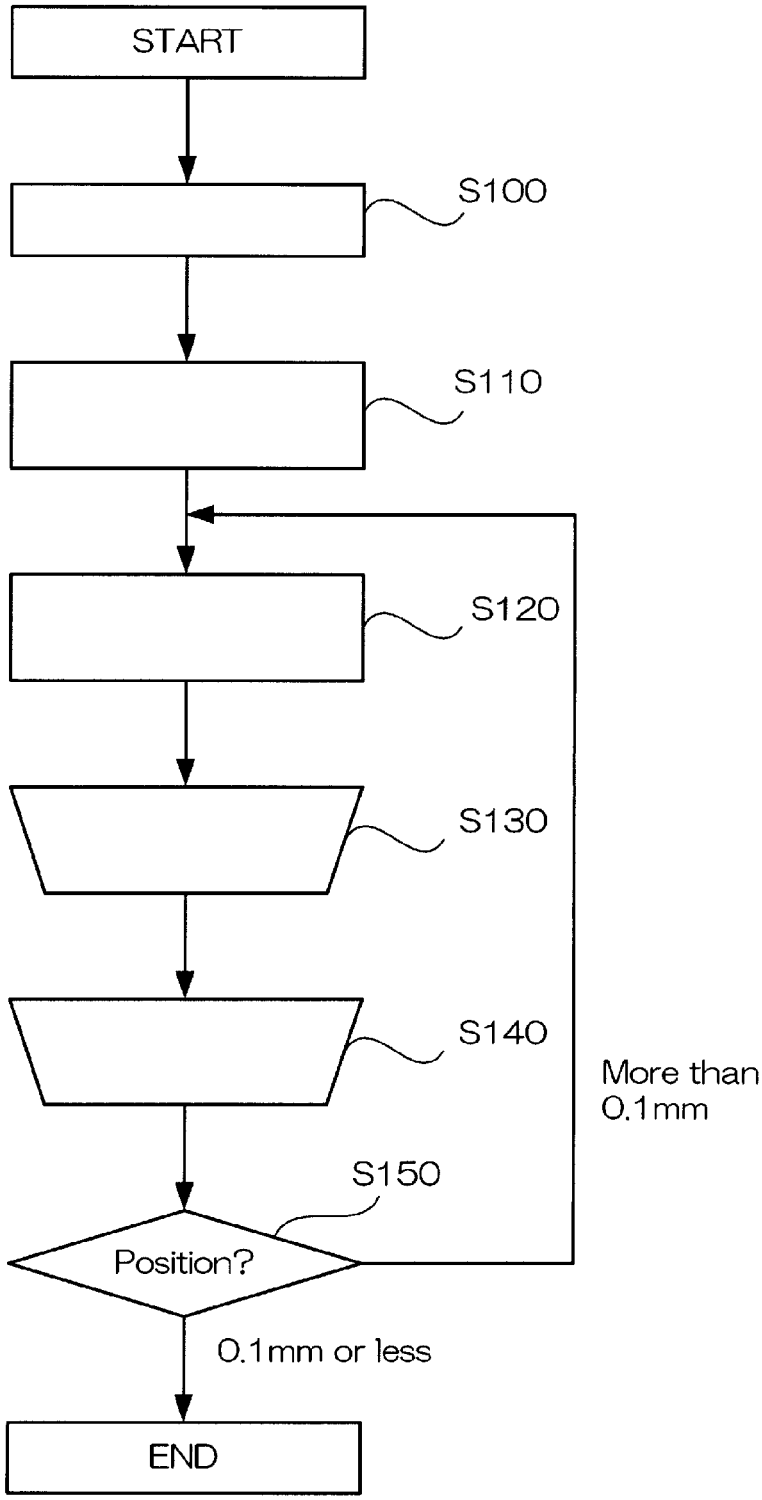
FIG. 7 shows a process flowchart of the alignment process according to the second embodiment.

The position adjustment method for the electromagnet of the above construction is explained with the process flow diagram in FIG. 7.

First of all, the three-dimensional coordinates (the initial position) of the measurement points 14*a* through 14*c* of the electromagnet 12 that is tentatively positioned on the beam transmission line are measured by the measurement device 16 located on the building reference point. (As seen in FIG. 7 as Step S100) The measured values are transmitted to the analyzing equipment 20, and then calculated the position information of the tentative reference point G.

In order to obtain the behavior characteristics of each actuator 18, the analyzing equipment 20 output signals to each of the actuators 18*a* through 18*h* positioned to the base portion 24 for moving a certain constant amount of movement. After the certain constant amount of movement, the three-dimensional coordinates of the measuring points 14*a* through 14*c* on the electromagnet 12 are measured by the measurement device 16 The results of the measurement relative to the constant amount of movement are transmitted to the analyzing equipment 20. (Step S110).

The analyzing equipment 20 expands the Jacobian matrix from the data obtained by the three-dimensional coordinate based upon the constant amount of movement of each actuators 18*a* through 18*h,* and calculate its generalized inverse matrix. (Step S120)

According to the amount of position adjustment for the actuators 18, the analyzing equipment 20 outputs the control signal to each actuator 18*a* through 18*h* and controls the position respectively. (Step S130).

After finishing the position adjustment of the actuator 18*a* through 18*h* of the electromagnet 12, the measurement device automatically calculates the three-dimensional position coordinates of the measurement positions 14*a* through 14*c* of the electromagnet. (Step 140)

In case that the deviation between the measured position of the electromagnet 12 and the predefined position is more than 0.1 mm, then it needs to recalculate the adjustment amount. For the purpose, it needs to go back to the Step S120. This operation will be repeated until the deviation become 0.1 mm or less, then complete this routine process. (Step S150)

As explained above, the analyzing equipment 20 calculate the position adjustment amount for the actuator 18*a* through 18*h* for shifting the electromagnet 12 from the provisional position to the predetermined position, and output the control signal to each of the actuators 18 to shift the electromagnet by the necessary amount of change. By doing this, the electromagnet 12 is moved to the predetermined preset position without unnecessary movements. Therefore, the installation of the electromagnet 12 takes less time and in high precision without repeating conventional trial and error process conducted by human operators by adjusting the adjustment bolts.

It is desirable for the measurement device 16 to measure the measurement values automatically and transmit the value to the analyzing equipment 20 automatically. Then the analyzing equipment 20 calculates the movement adjustment amount so as to reduce the amount of changes between the measured position and the predetermined position. The analyzing equipment 20 can output signals to the actuators 18 and perform the automatic position adjustment.

The third preferred embodiment relating to the alignment method and the alignment system for the electromagnet in the high-energy accelerator is explained below.

Figure 8:
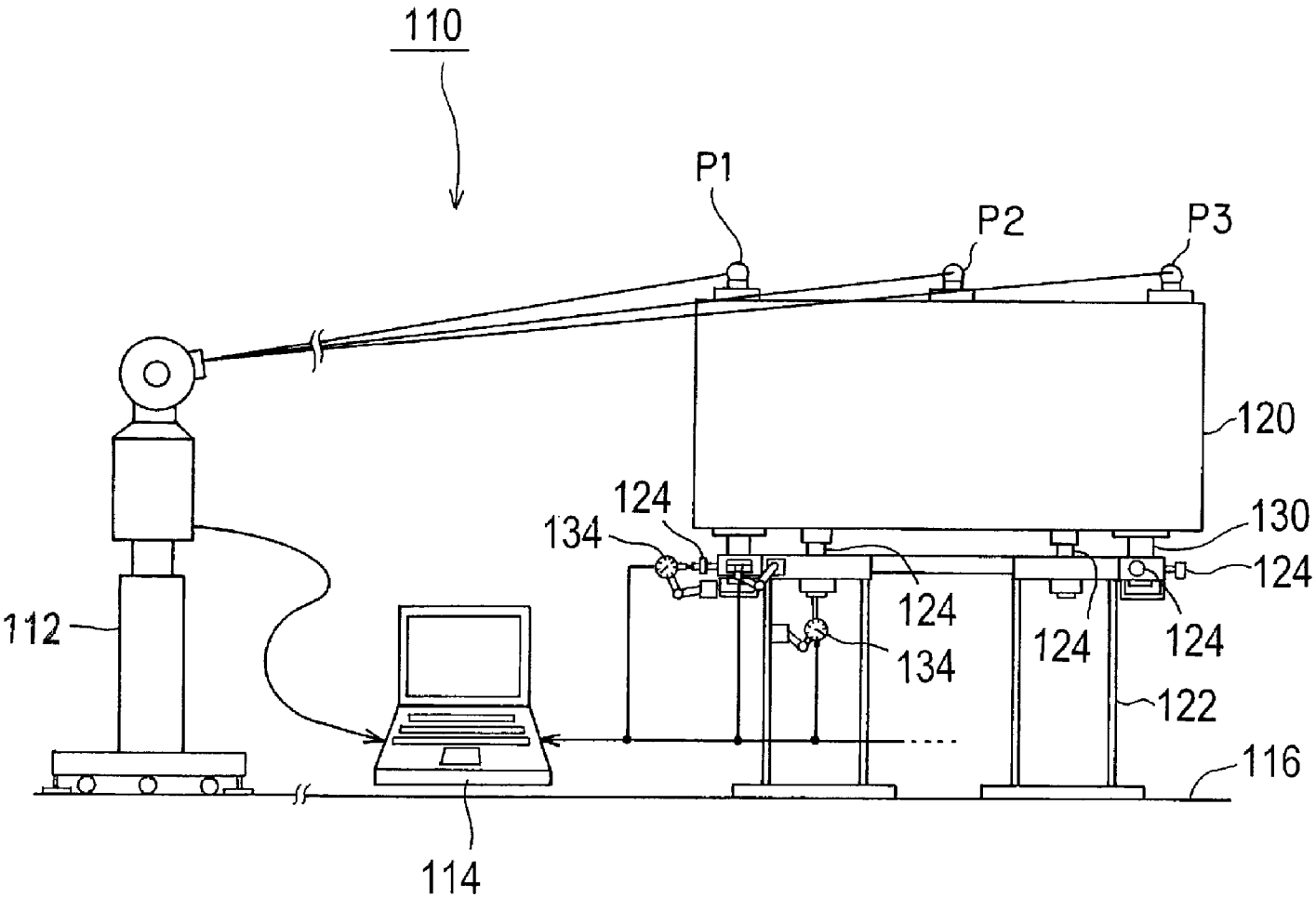
FIG. 8 shows a schematic for explaining the alignment system according to the third embodiment.
Figure 9:
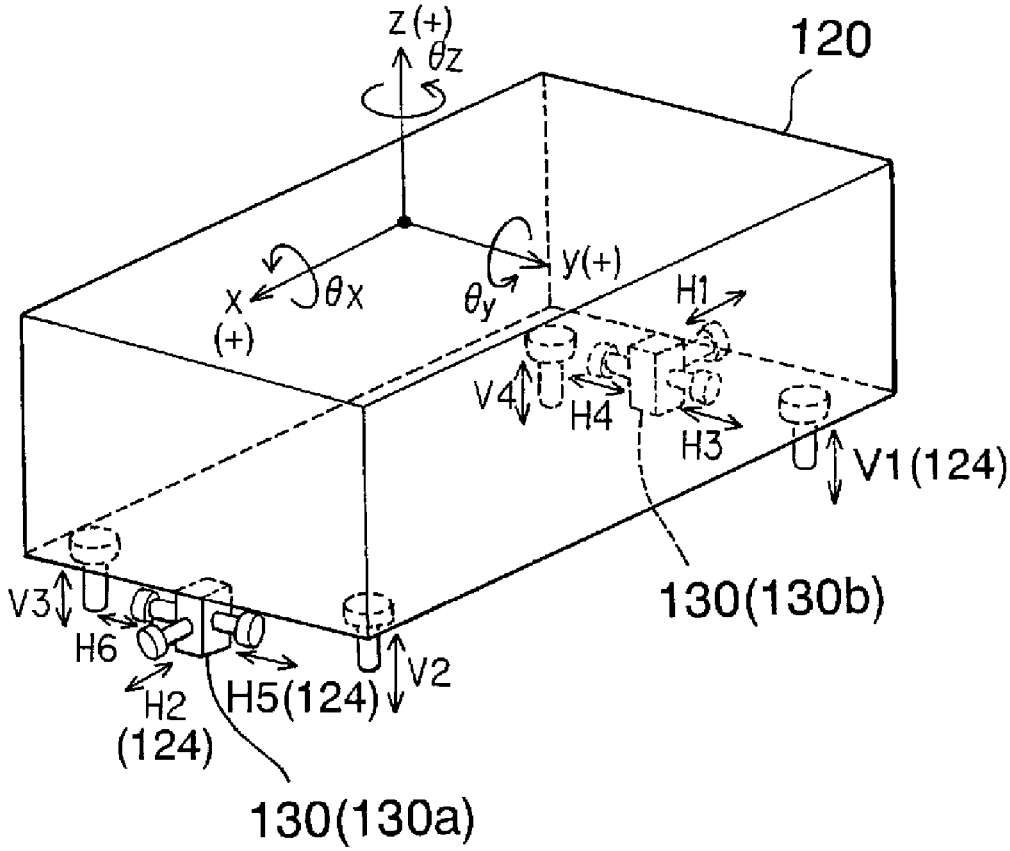
FIG. 9 shows a conceptual diagram for explaining the configuration position of the adjustment bolts according to the third embodiment.
Figure 10:
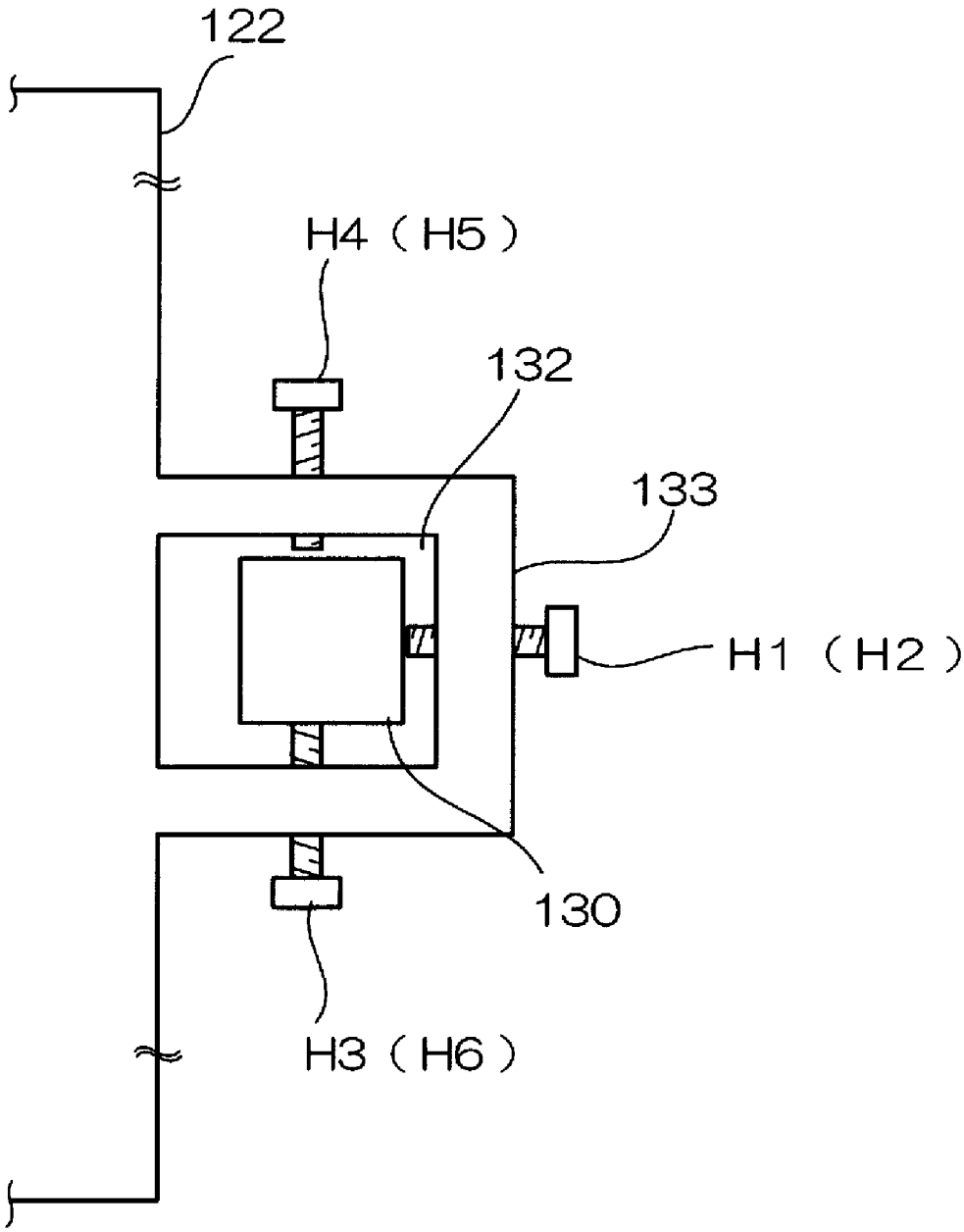
FIG. 10 a schematic of the configuration positions of the horizontal adjustment bolts according to the third embodiment.

FIG. 8 shows the schematic for the alignment system in this third embodiment. FIG. 9 is the conceptual diagram explaining about the position layout of the adjustment bolts. FIG. 10 shows the schematic for explaining the position layout of the horizontal adjustment bolts. It is noteworthy that, in this third embodiment, the X-axis of the first embodiment is shown as Y-axis, and Y-axis to be X-axis for the convenience of explanation.

The alignment system 110 shown in the FIG. 8 is equipped with the three-dimensional measurement device 112 and the analyzing equipment 114 for the deployment of electromagnet 120 with the alignment of the circular orbit of the high-energy particles. The electromagnet 120 is positioned on the base portion 122 that is positioned on the floor 116 in the building. The base portion 122 has the adjustment bolts 124, and the adjustment bolts 124 include the vertical adjustment bolts V1 through V4 and the horizontal adjustment bolts H1 through H6 that lead the electromagnet 120 in the vertical and horizontal directions respectively (As shown in FIG. 9). In this embodiment, there are four the vertical adjustment bolts V1 through V4 and six the horizontal adjustment bolts H1 through H6.

The vertical adjustment bolts V1 through V4 are movably projecting from the upper side of the mount portion 122 movable in vertical direction; the electromagnet 120 is located on the top of the vertical adjustment volts V1 through V4. More specifically, the vertical adjustment bolts V1 through V4 shown in the FIG. 9 are supporting the electromagnet 120 the four corners of the bottom surface. The electromagnet 120 has protuberances 130 on both longitudinal ends of the bottom portion; and the protuberances 130 are inserted in the rectangular housing openings 132 (See FIG. 10) whose inner holes are larger than the outer perimeter of the protuberances 130. The horizontal adjustment bolts H1 through H6 are movably engaged with the sidewalls 133 that form the rectangular housing opening 132 so as to move in the horizontal direction and abutted to the protuberance from 3 different directions that are outer sides of the electromagnet 120.

More specifically, with the protuberance 130*a* attached to the closer side of the electromagnet 120 in FIG. 9, the horizontal adjustment bolt H5 abuts to the protuberance 130*a* in −Y direction, so does the horizontal adjustment bolt H6 in +Y direction, and the horizontal adjustment bolt H2 in +X direction. And with the protuberance 130*b* attached to the far side of the electromagnet 120 in FIG. 9, the horizontal adjustment bolt H3 abuts to the protuberance 130*a* in +Y direction, so does the horizontal adjustment bolt H4 in −Y direction, and the horizontal adjustment bolt H1 in −X direction. With these mechanisms, the position and posture adjustment for the electromagnet 120 become possible with the adjustment bolts 124. For the accuracy of the adjustment, the tips of the vertical adjustment bolts V1 through V4 and the horizontal adjustment bolts H1 through H6 are rounded so that they create the point contacts with the electromagnet 120 and the protuberances 130.

Each adjustment bolts 124 are engaged with the dial gages 124 as shown in FIG. 8, the amounts of screw in/out are measured. It should be noted that the drawing for the dial gage 134 attached to the adjustment bolts 125 is just illustration purpose only so details are omitted for simplification purpose. Additionally, the three measurement target P1, P2 and P3 are positioned on the top of the electromagnet 120. The measurement targets P1 through P3 are not located in one line but at the apex of a triangle.

In the building where the accelerator is installed, the three-dimensional measurement device 112 is also installed for acquire the three-dimensional coordinates of the measurement targets P1 through P3. The three-dimensional measurement device 112 has the laser beam emission portion and the photo detector portion as well as the angular sensor (not show). The three-dimensional measurement device 112 measures the distance between the three-dimensional measurement device 112 and the measurement targets P1 through P3 as well as measures the angels by the angular sensor, by emitting the laser beam to the measurement target P1 through P3 and receiving the reflected light. Through this process, the three-dimensional measurement device 112 obtains the three-dimensional coordinates of the measurement targets P1 through P3. The three-dimensional measurement device 112 and dial gages 134 are connected to the analyzing equipment 114.

Figure 11:
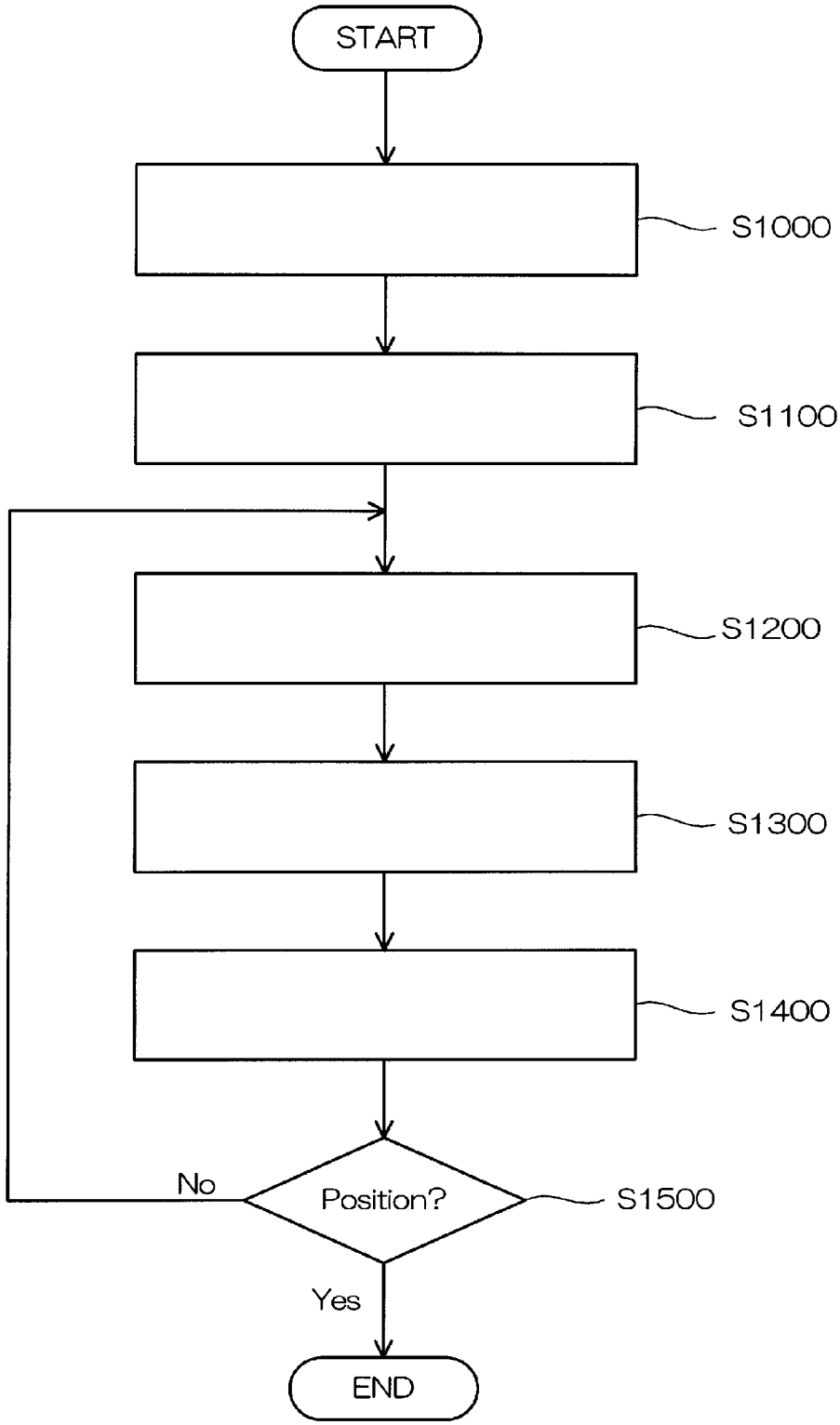
FIG. 11 shows process flowchart of the horizontal or vertical alignment process according to the third embodiment.
Figure 14:
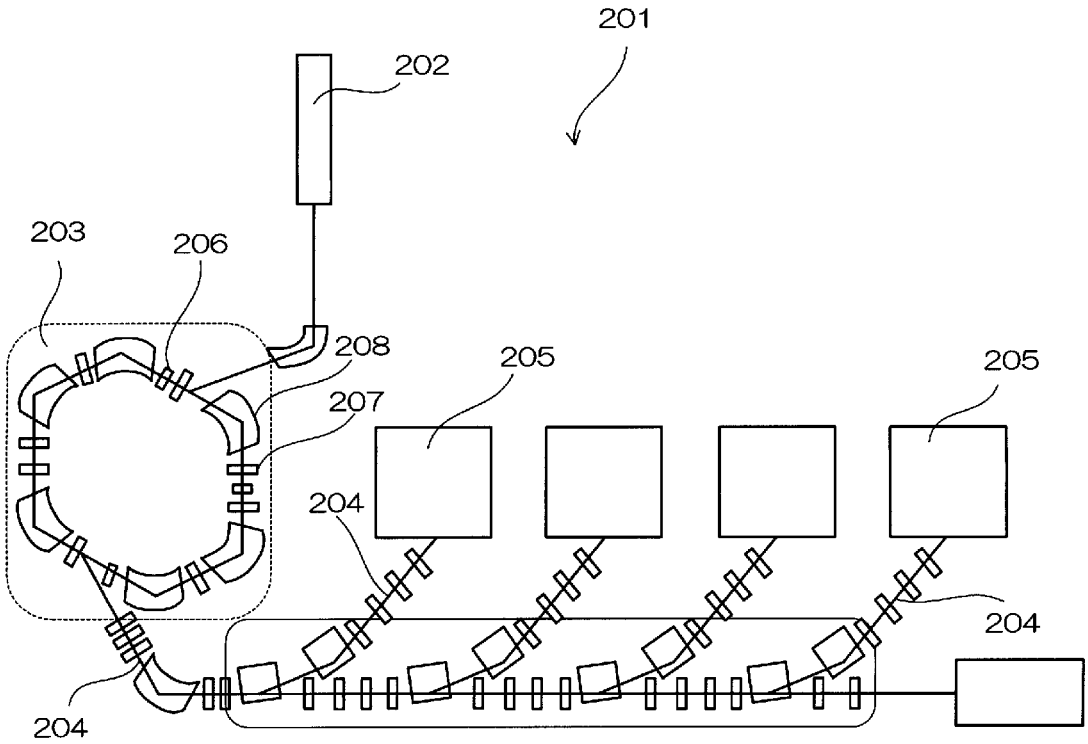
FIG. 14 shows a schematic of the high-energy acceleration system.

Now, the position adjustment and posture adjustment methods for the electromagnet 120 by using the alignment system 110 and the operation method for the adjustment bolts 124 are explained. FIG. 11 shows a flow chart showing the steps of adjusting the position and posture of the electromagnet in the vertical or horizontal direction. Preferably, the vertical direction proceeds to the horizontal adjustment. The three-dimensional measurement device 112 measures the initial position (three-dimensional coordinates) of each measurement targets P1 through P3 that are positioned on the top of the electromagnet 120. (Step S1000) The result of the measurement is transmitted from the three-dimensional measurement device 112 to the analyzing equipment 114.

Then, the measurement targets P1 through P3 are measured by the three-dimensional measurement device 112 after one of the adjustment bolt 124 is operated with a certain amount. (Step S1100) For a more specific example, the explanation will be made in the case that the vertical adjustment bolt V1 is advance (rotate the bolt to put the bolt tip to go forward) by a unit operational amount (such as 1 mm) and the one point of the electromagnet 120 has been lifted. Fist of all, the horizontal adjustment bolts H1 through H6 are tightened with the predetermined torque. The torque varies with the weight and shape of the electromagnet 120 etc., however, the amount such as 5 [Nm] is enough (see FIG. 12). The predetermined torque is enough torque to restrain the electromagnet 120 from moving in the horizontal direction, which is decided through some experiment or other process.

Then by confirming the reading of the dial gage 134 that is connected to the vertical adjustment bolt V1, the vertical adjustment bolt V1 is advance with predetermined amount. After that, the positions (three-dimensional coordinates) of each measurement targets P1 through P3 are measured by the three-dimensional measurement device 112, and the result of the measurement is output to the analyzing equipment 114. After finishing the measurement, the electromagnet 120 is set back to the original position by retracting (rotating the screw to put the screw tip go backward) the predetermined amount from the vertical adjustment bolt V1. Then, repeat the same process as the vertical measurement bolt V1 to the vertical adjustment bolts V2 and V3 respectively, and measure each measurement target P1 through P3 position after the predetermined operation.

In case that the electromagnet 120 is moved by adding the unit operation amount (such as 1 mm) to the horizontal adjustment bolt H1, the measurement of position of the measurement targets P1 through P3 become as follows: First, as the horizontal adjustment bolt H1 is operated, other measurement bolt H2 is retracted so as not to abut to the protuberance 130 and the other measurement bolts H3 through H6 are tightened by a predetermined torque. The predetermined torque varies with the weight and the shape or the like, however, the amount such as 5 [Nm] is enough (see FIG. 13). The predetermined torque is enough torque to restrain the electromagnet 120 from moving in the desired direction but not moving in the unwanted direction, which is decided through some experiment or other process.

While monitoring the reading of the dial gage 134 attached to the horizontal adjustment bolts H1, the horizontal adjustment bolt H1 is advanced by a predetermined amount. In case of FIG. 9, the direction to advance the horizontal adjustment bolt H1 for moving the electromagnet 120 is +X direction. And the three-dimensional measurement device 112 measures each measurement target P1 through P3 (three-dimensional coordinate) and outputs the result to the analyzing equipment 114. After finishing this measurement, set free (no or negligible contact force) the horizontal adjustment bolt H1 and retract the horizontal adjustment screw H2 with the same unit operation amount that was previously applied for resting the electromagnet to the original position. After this step, the horizontal adjustment bolt H2 is given the same process given to the horizontal adjustment bolt H1 and measures the positions of each of the measurement target P1 through P3 after predetermined process.

When measuring each position of the measurement target P1 through P3 after advancing the horizontal adjustment bolt H3 by a predetermined amount (such as 1 mm) for moving the electromagnet 120, the procedure becomes as explained below: First as the horizontal adjustment bolt H3 is subject for the operation, other horizontal adjustment bolts H1 and H4 are retracted for setting free the contact with the protuberance 130 and snugly tighten the other horizontal adjustment bolts H2, H5 and H6 with a predetermined torque. The predetermined torque varies with the weight and the shape or the like, however, the amount such as 5 [Nm] is enough (see FIG. 13). The predetermined torque is enough torque to restrain the electromagnet 120 from moving in the desired direction but not moving in the unwanted direction, which is decided through some experiment or other process.

While monitoring the reading of the dial gage 134 attached to the horizontal adjustment bolts H3, the horizontal adjustment bolt H3 is advanced by a predetermined amount. In case of FIG. 9, the electromagnet 120 rotationally moves about the closer one of protuberance 130*a*, when the horizontal adjustment bolt H3 is advanced. And the three-dimensional measurement device 112 measures each measurement target P1 through P3 (three-dimensional coordinate) and outputs the result to the analyzing equipment 114. After finishing this measurement, retract the horizontal adjustment screw H3 with the same unit operation amount that was previously applied for resting the electromagnet to the original position. After this step, the same process given to the horizontal adjustment bolts H3 is applied to the horizontal adjustment screws H4, H5 and H6, and measures the positions of each of the measurement target P1 through P3 after predetermined amount is applied through the operation.

The torques to be applied to each of the adjustment bolts 124 for adjusting the electromagnet 120 when operating each of the adjustment bolt 124 are indicated in the tables of FIGS. 12 and 13 as an example. In this example, the applied torques for the horizontal adjustment bolts H1 through H6 when each of the vertical adjustment bolts V1 through V4 is operated are listed in the table of FIG. 12, and the applied torques for the horizontal adjustment bolts H1 through H6 respectively when each of the horizontal adjustment bolts H1 through H6 is operated respectively are listed in the table of FIG. 13.

Based on the position information of the measurement target P1 through P3 that are measured in the step S1100, the analyzing equipment 124 obtains the adjustment amounts for each adjustment bolts 124 for install the electromagnet 120 to the designed position. (Step S1200) How to obtain the adjustment amount is the same as that of the first embodiment described above. The adjustment of the adjustment bolts 124 can be done by manually or the actuators similar to the first embodiment. The three-dimensional coordinate data relative to the building reference point as the origin are stored in the memory, so the three-dimensional measurement device 112 located on the building reference point measures the current position and posture of the electromagnet 120. After that, the tentatively positioned electromagnet 120 is precisely and quickly to the target position by sequentially process each steps described in FIG. 3. Namely, each of the multiple actuators for changing the position and posture of the electromagnet 120 is moved by a unit operation amount individually. At the time, except for the actuator that is subject to the operation, other actuators are not operated, and the movements of the actuators other than those allows lateral and rotational movements caused by the actuator in operation are restricted to the base portion 24. By expanding to a Jacobian matrix, and obtaining the generalized inverse matrix of the Jacobian matrix with the previously obtained current deviation value of the electromagnet 120 from the target value, the necessary amount of the operation can be obtained for eliminating the deviation. This type of process is the same as the first embodiment that follows the equations (1) through (11) described above.

According to the adjustment amount of the three (3) bolts among the vertical adjustment bolts V1 through V4 or the horizontal adjustment bolts H1 through H6 obtained from the step S1200, each of the three bolts among the vertical adjustment bolt V1 through V4 or the horizontal adjustment bolt H1 through H6 are operated accordingly (Step S1300). As explained at the Step S1100, when the one of the horizontal adjustment bolts 124 is operated, the other adjustment bolts 124 are tightened with a predetermined torque. For example, when one of the vertical adjustment bolts V1 through V4 is to be adjusted, the horizontal adjustment bolts H1 through H6 are tightened with the predetermined torque listed in the table of FIG. 12. In the same way, when one of the horizontal adjustment bolts H1 through H6 is to be adjusted, the other horizontal adjustment bolts H1 through H6 are tightened with the predetermined torque or set fee as listed in the table of FIG. 13.

After the adjustments for each adjustment bolts 124 according to the calculated amount of adjustment, the positions of the measurement targets P1 through P3 are measured by the three-dimensional measurement device 112 (Step S1400). The measurement results are transmitted to the analyzing equipment 114; and the analyzing equipment 114 checks if the measured positions of the measurement positions P1 through P3 represent the desired position of the electromagnet 120 accurately or not (Step S1500). That means, it checks if the electromagnet 120 is positioned accurately aligned in the circular orbit of the high energy particles. For example, the tolerance for installation position of the electromagnet 120 is ±0.1 mm. After checking the position of the electromagnet 120, the operation goes to the end if the electromagnet 120 is installed in the desired position within a given tolerance range. Contrary to that, repeat the steps of S1200 through S1500 if the electromagnet 120 is not installed to the desired position accurately. The above sequence of operation (S1000 through S1500) is conducted for the vertical and horizontal adjustment respectively; then completes the entire adjustment operation.

According to this type of operation with respect to the adjustment bolts 124, the electromagnet 120 is moved only in the desired direction since the non-operational adjustment bolts 124 are either tighten with a predetermined torque or set free while the operational adjustment bolt 124 are in operation. At the same time, there is no problem facing a situation that causes unwanted interference for the movement of the electromagnet 120 with the adjustment bolts 124 that should be set free and shouldn't be tighten by following the process according to the embodiment.

By obtaining the Jacobian matrix through the above operation to the adjustment bolts 124, the relationship in the coordinate system between the adjustment amount of the adjustment bolts 124 and the position of the electromagnet 120 is obtainable quantitatively and reputably. Utilizing the adjustment amounts for the adjustment bolts 124 obtained from the inverse operation from the Jacobian matrix and applying the adjustment amounts to the adjustment bolts 124 in the way described above, the electromagnet 120 can be installed to the desired position easily with shorter number of trial. Therefore, the necessary time for the position adjustment and posture adjustment of the electromagnet 120 is shortened and become predictable, hence the estimate of the total period for the installation of the accelerator become more reliable.

As the adjustment amount for the adjustment bolts 124 and the changes in the coordinate of the electromagnet 120 become obtainable predictably, reputably and quantifiably, the installation operation of the electromagnet that required experience and trained skills become more efficient and almost skill-free, and the operation time become even out.

While the invention herein disclosed has been described by means of specific embodiments and applications thereof, numerous modifications and variations could be made thereto by those skilled in the art without departing from the scope of the invention set forth in the claims.

What is claimed is:

1. An alignment method for an electromagnet in a high energy accelerator comprising the steps of:

measuring a multiple of measuring reference points for obtaining a position/posture of the electromagnet;

obtaining a deviation from a present value with an installation target value of the electromagnet within a reference coordinates of a building;

obtaining a relationship between an unit operation amount and changes in the position/posture of the electromagnet with a Jacobian matrix with respect to each adjustment mechanism of multiple adjustment mechanisms for adjusting the position/posture of the electromagnet;

calculating an operation amount for said each adjustment mechanism by multiplying said deviation amount with a inverse matrix derived from said Jacobian matrix; and aligning said position/posture to the installation target value by operating said adjustment mechanisms with said operation amounts obtained from the step of calculating.

2. The alignment method of claim 1 wherein a horizontal adjustment is conducted after finishing a vertical adjustment and an adjustment of posture during said step of aligning.

3. The alignment method of claim 1 wherein said adjustment mechanisms include adjustment bolts and actuators that produce rotational movements to the adjustment bolts, and the adjustment operation is conducted by applying drive signals corresponding to said operation amount obtained from the calculation to the actuators and producing rotational movements to the adjustment bolts for the vertical, posture and horizontal adjustment.

4. An alignment method for an electromagnet in a high energy accelerator comprising the steps of:

measuring a multiple of measuring reference points for obtaining a position/posture of the electromagnet;

obtaining a deviation from a present value with an installation target value of the electromagnet within a reference coordinates of a building;

obtaining a relationship between an unit operation amount and changes in the position/posture of the electromagnet in a vertical direction while restricting horizontal movements with respect to each adjustment mechanism of multiple of adjustment mechanisms for adjusting the position/posture of the electromagnet;

obtaining a relationship between a unit operation amount with respect to a horizontal movement and a horizontal rotational change by restraining relative movements of the electromagnet other than a desired direction for each operation of one of said adjustment mechanisms that relate to the horizontal;

calculating each operation amount for said each adjustment mechanism by multiplying said deviation with said unit operation amount for said each adjustment mechanism; and aligning said position/posture to the installation target value by operating said adjustment mechanisms with said unit operation amounts obtained from the calculation.

5. The alignment method of claim 4 wherein said restraining relative movements of the electromagnet is achieved by tightening up and restraining the electromagnet with said adjustment mechanisms that are not currently subject to said operation by applying a restraining torque so as not to move the electromagnet.

6. An alignment method for an electromagnet in a high energy accelerator including vertical and horizontal adjustment mechanisms located in the vicinity of the electromagnet, and adjusting position and posture of the electromagnet by utilizing the vertical and horizontal adjustment mechanisms comprising the steps of:

predetermining a set of restraining torques for the horizontal adjustment mechanisms for allowing a vertical movement while restraining a horizontal movement of the electromagnet when operating the vertical adjustment mechanisms;

moving the electromagnet in the vertical direction using the vertical adjustment mechanism while the horizontal adjustment mechanisms are tightly fastened by said set of restraining torques;

predetermining a second set of restraining torques for other horizontal adjustment mechanisms than a horizontal adjustment mechanism that is subject to the operation, for restricting a direction of movement to allow only to a desired direction; and moving the electromagnet in the horizontal direction by operating one of the horizontal adjustment mechanisms while the other horizontal adjustment mechanisms are tightly fastened by said second set of restraining torques.

7. An alignment method for an electromagnet in a high energy accelerator including a vertical and a horizontal adjustment mechanism located at the bottom of the electromagnet, and adjusting position and posture of the electromagnet by utilizing the vertical and horizontal adjustment mechanisms comprising the steps of:

predetermining a set of restraining torques for the horizontal adjustment mechanisms for allowing a vertical movement while restraining a horizontal movement of the electromagnet; and moving the electromagnet in the vertical direction using the vertical adjustment mechanism while the horizontal adjustment mechanisms are tightly fastened by said set of restraining torques.

8. An alignment method for an electromagnet in a high energy accelerator including horizontal adjustment mechanisms located at the bottom of the electromagnet, and adjusting position and posture of the electromagnet by utilizing the horizontal adjustment mechanisms comprising the steps of:

predetermining a set of restraining torques for other horizontal adjustment mechanisms than a horizontal adjustment mechanism that is subject to the operation, for restricting a direction of movement to allow only to a desired direction; and moving the electromagnet in the horizontal direction by operating one of the horizontal adjustment mechanisms while the other horizontal adjustment mechanisms are tightly fastened by said set of restraining torques.

9. An alignment method for an electromagnet in a high energy accelerator comprising the steps of:

deploying a plurality of adjustment mechanisms for adjusting position and posture of the electromagnet;

predetermining a set of restraining torques for other adjustment mechanisms than one of the adjustment mechanisms that is subject to the operation, for moving the electromagnet with the one of the adjustment mechanisms;

measuring positions/postures of the electromagnet after moving the electromagnet by operating the one of the adjustment mechanisms while the other adjustment mechanisms are operated to be tightly fastened by said set of restraining torques, which is done for each of the adjustment mechanisms;

obtaining adjustment operation amounts for said each of the adjustment mechanisms from the result of said step of measuring, utilizing an inverse matrix of a Jacobian matrix; and adjusting the position/posture of the electromagnet by operating the one of the adjustment mechanisms in response to said adjustment operation amount while the other adjustment mechanisms are tightly fastened by said set of restraining torques.

10. An alignment system for an electromagnet in a high energy accelerator comprising:

multiple adjustment mechanisms deployed in the vicinity of the electromagnet for adjusting a position and a posture of the electromagnet;

measurement reference points located on the electromagnet;

measurement means located in a building where the electromagnet is deployed for measuring the position of said measurement reference points; and analyzing means for calculating adjustment operation amounts for said multiple adjustment mechanisms for adjusting the position of the electromagnet to a desired position;

wherein, said analyzing means further includes an operation processing portion for calculating deviations between installation target values and present values obtained from the positions of said measurement reference points measured by said measurement means, and an operation processing portion for calculating said adjustment operation amounts for said multiple adjustment mechanisms relative to said deviations by expanding relationship between a unit operation amount of each one of the adjustment mechanisms with the posture change of the electromagnet to a Jacobian matrix.

11. The alignment system of claim 10 wherein said adjustment mechanisms include adjustment bolts, and wherein positions in horizontal and vertical directions of the electromagnet are adjusted by rotating said adjustment bolts deployed in the vicinity of the electromagnet.

12. The alignment system of claim 10 wherein said adjustment mechanisms are fluid driven means, and wherein positions in horizontal and vertical directions of the electromagnet are adjusted by driving said fluid driven means deployed in the vicinity of the electromagnet.

13. The alignment system of claim 10 wherein said adjustment mechanisms further include adjustment bolts and rotationally driven actuators, and wherein positions in horizontal and vertical directions of the electromagnet are adjusted by rotating said adjustment screws by said actuators deployed in the vicinity of the electromagnet.

14. The alignment system of claim 10 wherein said adjustment mechanisms are operated by the instruction from said analyzing means.

15. The alignment system of claim 10 wherein said adjustment mechanisms are deployed at a sidewall and a bottom of a base portion that supports the electromagnet.

16. The alignment system of 10 wherein said analyzing means is constructed to conduct an automatic position adjustment based upon an amount of change between the present values and the target values.

* * * * *